US011358298B2

(12) United States Patent
Baxter et al.

(10) Patent No.: US 11,358,298 B2
(45) Date of Patent: Jun. 14, 2022

(54) KNIFE ASSEMBLIES FOR SLICING MACHINES AND MACHINES EQUIPPED THEREWITH

(71) Applicant: Urschel Laboratories, Inc., Chesterton, IN (US)

(72) Inventors: Corey Everette Baxter, Valparaiso, IN (US); Michael Scot Jacko, Valparaiso, IN (US); Ryan Andrew Rust, Hebron, IN (US)

(73) Assignee: Urschel Laboratories, Inc., Chesterton, IN (US)

( * ) Notice: Subject to any disclaimer, the term of this patent is extended or adjusted under 35 U.S.C. 154(b) by 0 days.

(21) Appl. No.: 17/242,694

(22) Filed: Apr. 28, 2021

(65) Prior Publication Data

US 2021/0245387 A1 Aug. 12, 2021

Related U.S. Application Data

(62) Division of application No. 16/239,642, filed on Jan. 4, 2019, now Pat. No. 11,034,043.

(60) Provisional application No. 62/613,840, filed on Jan. 5, 2018.

(51) Int. Cl.

| | |
|---|---|
| ***B26D 7/26*** | (2006.01) |
| ***B26D 1/36*** | (2006.01) |
| ***B26D 1/62*** | (2006.01) |
| ***B26D 3/28*** | (2006.01) |
| ***B26D 7/06*** | (2006.01) |
| ***B26D 1/03*** | (2006.01) |

(52) U.S. Cl.
CPC ..... *B26D 7/2614* (2013.01); *B26D 1/03* (2013.01); *B26D 7/0691* (2013.01); *B26D 2210/02* (2013.01)

(58) Field of Classification Search
CPC .... B26D 1/03; B26D 2210/02; B26D 7/0691; B26D 7/2614; Y10T 83/9457–949
See application file for complete search history.

(56) References Cited

U.S. PATENT DOCUMENTS

| | | | | |
|---|---|---|---|---|
| 5,694,824 | A * | 12/1997 | Jacko | B26D 7/2614 83/858 |
| 6,116,130 | A | 9/2000 | Cogan | |
| 7,178,440 | B2 * | 2/2007 | Bucks | B26D 1/29 83/591 |
| 2005/0150345 | A1 | 7/2005 | Bucks | |

(Continued)

*Primary Examiner* — Stephen Choi
(74) *Attorney, Agent, or Firm* — Hartman Global IP Law; Gary M. Hartman; Domenica N. S. Hartman

(57) ABSTRACT

Knife assemblies adapted for use in slicing machines includes a knife holder having a support surface that defines an outer upper surface of the knife holder and a leading edge of the knife holder. An insert is supported by the knife holder and has leading and trailing ends that each extends along a longitudinal extent of the knife holder, and a longitudinal end between the leading and trailing ends. A knife is at least partly supported by the insert and has a cutting edge that projects beyond the leading end of the insert. The knife is clamped to the knife holder and the insert is secured to the knife holder by at least a first slot defined in the trailing end and/or longitudinal end of the insert, and at least a first locking post that engages the first slot and secures the insert to the knife holder.

20 Claims, 23 Drawing Sheets

(56) References Cited

U.S. PATENT DOCUMENTS

| | | | | |
|---|---|---|---|---|
| 2007/0240550 | A1* | 10/2007 | Jacko ..... | B26D 1/36<br>83/403 |
| 2017/0050329 | A1 | 2/2017 | Michel et al. | |

* cited by examiner

KNIFE ASSEMBLIES FOR SLICING MACHINES AND MACHINES EQUIPPED THEREWITH

CROSS REFERENCE TO RELATED APPLICATIONS

This is a division patent application of U.S. patent application Ser. No. 16/239,642, filed Jan. 4, 2019, which claims the benefit of U.S. Provisional Application No. 62/613,840, filed Jan. 5, 2018. The contents of these prior applications are incorporated herein by reference.

BACKGROUND OF THE INVENTION

The present invention generally relates to machines for cutting products, including but not limited to slicing food products. The invention particularly relates to knife assemblies for securing knives to slicing machines.

Various types of equipment are known for slicing, shredding and granulating food products, as nonlimiting examples, vegetables, fruits, dairy products, and meat products. Widely used machines for this purpose are commercially available from Urschel Laboratories, Inc., and include machines under the names Model CC® and Model CCL. The Model CC® and CCL machines are centrifugal-type slicers capable of slicing a wide variety of products at high production capacities. The Model CC® line of machines is particularly adapted to produce uniform slices, strip cuts, shreds and granulations, and the Model CCL line is particularly adapted to produce slices or chips of a waffle or lattice type. Certain configurations and aspects of Model CC® machines are represented in U.S. Pat. Nos. 3,139,128, 3,139,129, 5,694,824, 6,968,765, 7,658,133, 8,161,856, and 9,193,086 and U.S. Patent Application Publication Nos. 2014/0290451, 2016/0158953, and 2016/0361831, the entire contents of which are incorporated herein by reference. Certain configurations and aspects of Model CCL machines are represented in U.S. Pat. Nos. 3,139,127 and 3,139,130, the entire contents of which are incorporated herein by reference.

FIG. 1 schematically depicts a machine 10 representative of a Model CC® machine. The machine 10 includes a generally annular-shaped cutting head 12 equipped with cutting knives (not shown) mounted along its circumference. An impeller 14 is coaxially mounted within the cutting head 12 and has an axis 17 of rotation that coincides with the center axis of the cutting head 12. The impeller 14 is rotationally driven about its axis 17 through a shaft that is enclosed within a housing 18 and coupled to a gear box 16. The cutting head 12 is mounted on a support ring 15 above the gear box 16 and remains stationary as the impeller 14 rotates. Products are delivered to the cutting head 12 and impeller 14 through a feed hopper 11 located above the impeller 14. In operation, as the hopper 11 delivers products to the impeller 14, centrifugal forces cause the products to move outward into engagement with the knives of the cutting head 12. The impeller 14 comprises generally radially-oriented paddles 13, each having a face that engages and directs the products radially outward toward and against the knives of the cutting head 12 as the impeller 14 rotates. Other aspects pertaining to the construction and operation of Model CC® machines, including improved embodiments thereof, can be appreciated from U.S. Pat. Nos. 3,139,128, 3,139,129, 5,694,824, 6,968,765, 7,658,133, 8,161,856, and 9,193,086 and U.S. Patent Application Publication Nos. 2014/0290451, 2016/0158953, and 2016/0361831.

FIG. 2 is an isolated view of the cutting head 12 of FIG. 1, and FIG. 3 is a fragmentary bottom view of the cutting head 12. The cutting head 12 is generally annular-shaped with cutting knives 20 mounted along its perimeter. Each knife 20 projects radially inward in a direction generally opposite the direction of rotation of the impeller 14 (not shown in FIG. 2 or 3), and defines a cutting edge at its radially innermost extremity. The cutting head 12 is shown in FIG. 2 as further comprising a lower support ring 22, an upper support ring 24, and circumferentially-spaced support segments, referred to herein as shoes 26. The knives 20 of the cutting head 12 are individually secured to the shoes 26 as part of knife assemblies 28. Each knife assembly 28 includes a knife holder 28A mounted to the radially inward-facing side of a shoe 26, and a clamp 28B mounted on the radially outward-facing side of a shoe 26 to secure a knife 20 to the knife holder 28A. The shoes 26 are represented as secured with bolts 30 to the support rings 22 and 24. The shoes 26 are equipped with coaxial pivot pins (not shown) that engage holes in the support rings 22 and 24. By pivoting on its pins, the orientation of a shoe 26 can be adjusted to alter the radial location of the cutting edge of its knife 20 with respect to the axis of the cutting head 12, thereby controlling the thickness of the sliced product. As an example, adjustment can be achieved with an adjusting screw and/or pin 32 located circumferentially behind the pivot pins. FIG. 2 further shows optional gate insert strips 34 mounted to each shoe 26, which the product crosses prior to encountering the knife 20 mounted to the succeeding shoe 26.

FIGS. 2 and 3 show the knives 20 and clamps 28B secured to their respective knife holders 28A with bolts 36. Alignment of the knife 20 and clamp 28B of each assembly 28 is achieved with pins 38 that protrude from the support surface of the knife holder 28A. As better understood through the detail view of FIG. 4, the opposing surfaces of the knife holder 28A and clamp 28B result in the clamp 28B applying a force to the knife 20 adjacent its cutting edge.

Because of its proximity to the cutting edge of the knife 20, the leading edge of the knife holder 28A is vulnerable to damage, for example, from impacts with stones and other debris that often accompany food products such as potatoes. Knife holders of the type represented in FIGS. 3 and 4 are typically much more costly components in comparison to the knives they support. FIG. 5 depicts an alternative configuration of a knife assembly 40 configured to address this issue. The knife assembly 40 comprises a knife holder 40A and clamp 40B, the latter of which may be similar if not identical to the clamp 28B of FIGS. 2 and 3. The knife holder 40A includes an insert 42 that supports the knife 20 near its cutting edge and serves to protect the leading edge 44 of the knife holder 40A from stones or other debris that the edge 44 would otherwise encounter. The insert 42 (sometimes referred to as a bumper) is received in a slot 46 that extends along at least a portion of the leading edge 44 of the holder 40A and is generally parallel to the longitudinal length of the holder 40A. As depicted in FIG. 5, the portion of the insert 42 received in the slot 46 generally has a rectangular cross-sectional shape and, aside from relief cuts in its corners, the slot 46 is similarly shaped. The insert 42 and its slot 46 may be sized to precisely position and secure the insert 42 within the slot 46. The insert 42 protrudes from the slot 46 and beyond the leading edge 44 of the holder 40A to support the knife 20 near its cutting edge.

While centrifugal-type slicers of the type represented by the Model CC® have performed extremely well for their intended purpose, further improvements are continuously desired and sought.

BRIEF DESCRIPTION OF THE INVENTION

The present invention provides knife assemblies adapted for use in slicing machines, including centrifugal-type slicing machines having a cutting head with one or more knife assemblies mounted thereto.

According to one aspect, a knife assembly includes a knife holder having a support surface that defines an outer upper surface of the knife holder and a leading edge of the knife holder, and an insert supported by the knife holder. The insert has a leading end that extends along a longitudinal extent of the knife holder and projects beyond the leading edge of the knife holder, a trailing end that extends along the longitudinal extent of the knife holder and is located on an opposite side of the insert from the leading end, and a longitudinal end between the leading and trailing ends. A knife is at least partly supported by the insert and has a cutting edge that projects beyond the leading end of the insert. The knife is clamped to the knife holder and the insert is secured to the knife holder by at least a first slot defined in at least one of the trailing end and the longitudinal end of the insert, and at least a first locking post that engages the first slot of the insert and secures the insert to the knife holder.

Technical aspects of knife assemblies as described above preferably include the ability to protect a leading edge of a knife holder with an insert that can be quickly assembled to the knife holder and will remain reliably secured to the knife holder during the operation of a slicing machine. Additionally, the insert is preferably configured to reduce the likelihood that the insert will be incorrectly installed on the knife holder.

Other aspects and advantages of this invention will be better appreciated from the following detailed description.

DETAILED DESCRIPTION OF THE INVENTION

Figure 1:
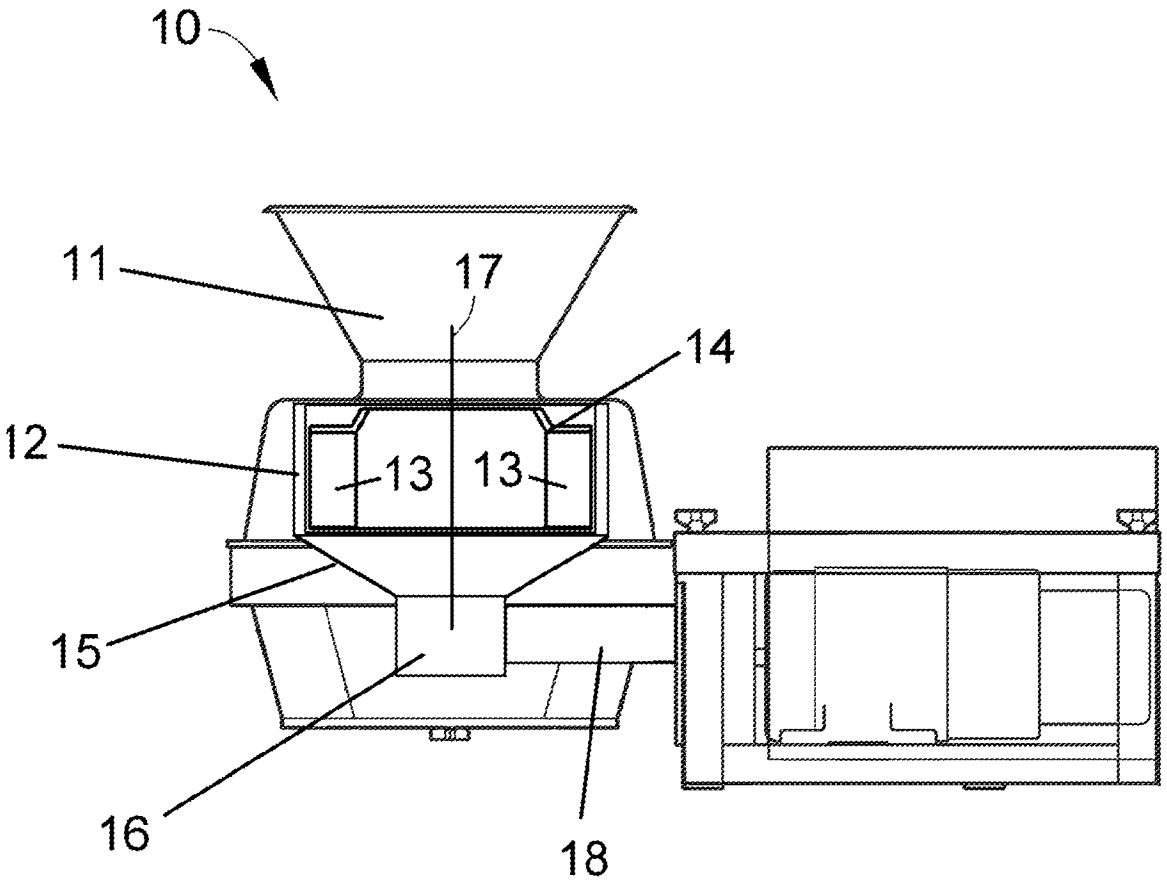
FIG. 1 PRIOR ART
FIG. 1 schematically represents a side view in partial cross-section of a slicing machine known in the art.

FIGS. 6 through 23B depict knife assemblies and components thereof that are capable of use with a variety of cutting machines, including the centrifugal-type slicing machine 10 depicted in FIG. 1, and in some instances may be a modification or retrofit for such a machine. Nonlimiting embodiments of the invention will be illustrated and described hereinafter in reference to the slicing machine 10 of FIG. 1 equipped with an impeller 14 and annular-shaped cutting head 12 as described in reference to FIGS. 1 through 4, and as such the following discussion will focus primarily on certain aspects of the invention that will be described in reference to the slicing machine 10 and cutting head 12, whereas other aspects not discussed in any detail below may be, in terms of structure, function, materials, etc., essentially as was described in reference to FIGS. 1 through 4. However, it will be appreciated that the teachings of the invention are also generally applicable to other types of cutting machines.

Figure 2:
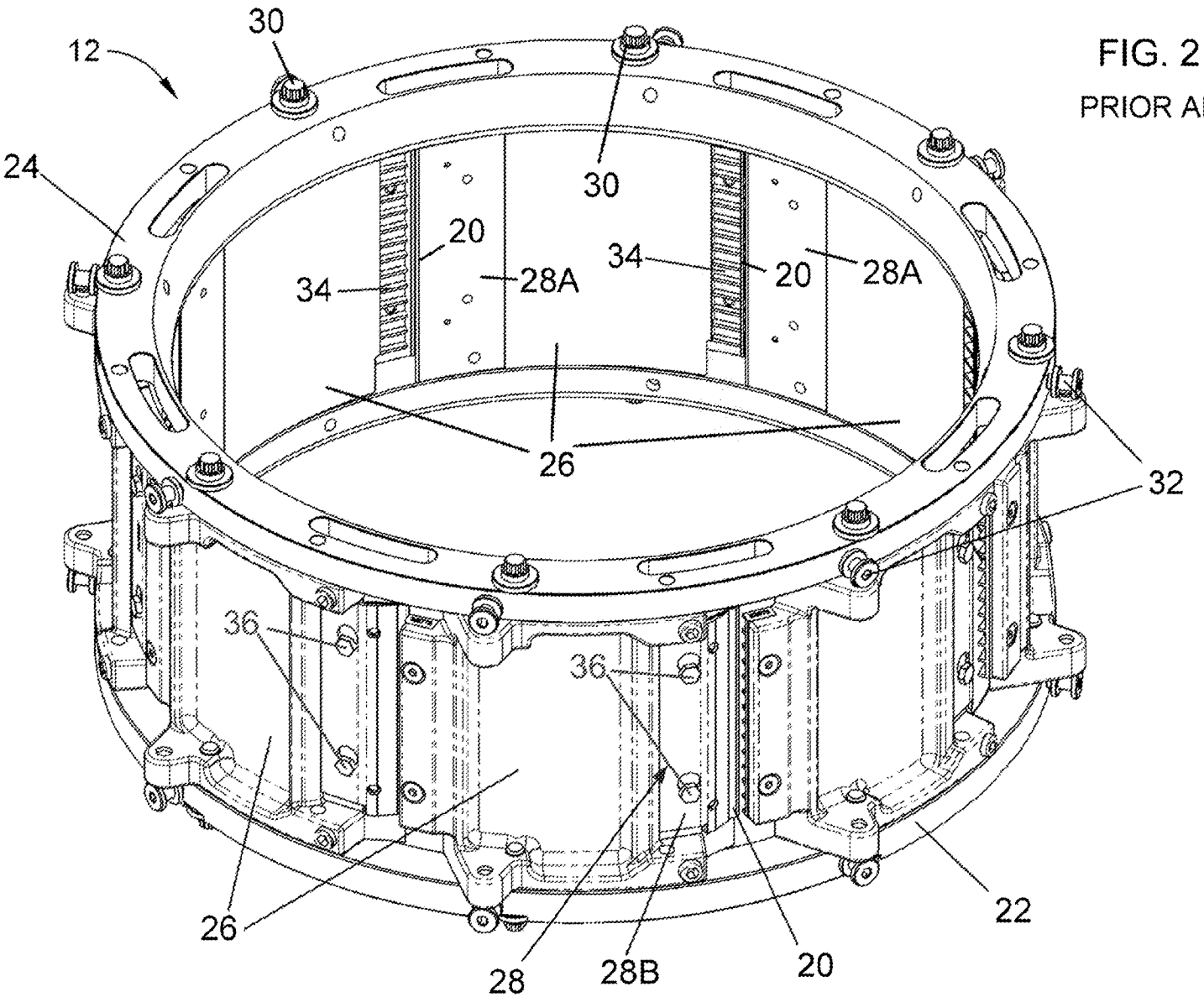
FIG. 2 PRIOR ART
FIG. 2 is a perspective view representing details of a cutting head of a type suitable for use in the slicing machine of FIG. 1.

To facilitate the description provided below of the embodiments represented in the drawings, relative terms may be used in reference to the orientation of the cutting head 12 as represented in FIG. 2. On the basis of the coaxial arrangement of the cutting head 12 and impeller 14 of the machine 10 represented in FIG. 1, relative terms including but not limited to "axial," "circumferential," "radial," etc., and related forms thereof may also be used below to describe the nonlimiting embodiments represented in the drawings. All such relative terms are useful to describe the illustrated embodiments but should not be otherwise interpreted as limiting the scope of the invention.

Figure 3:
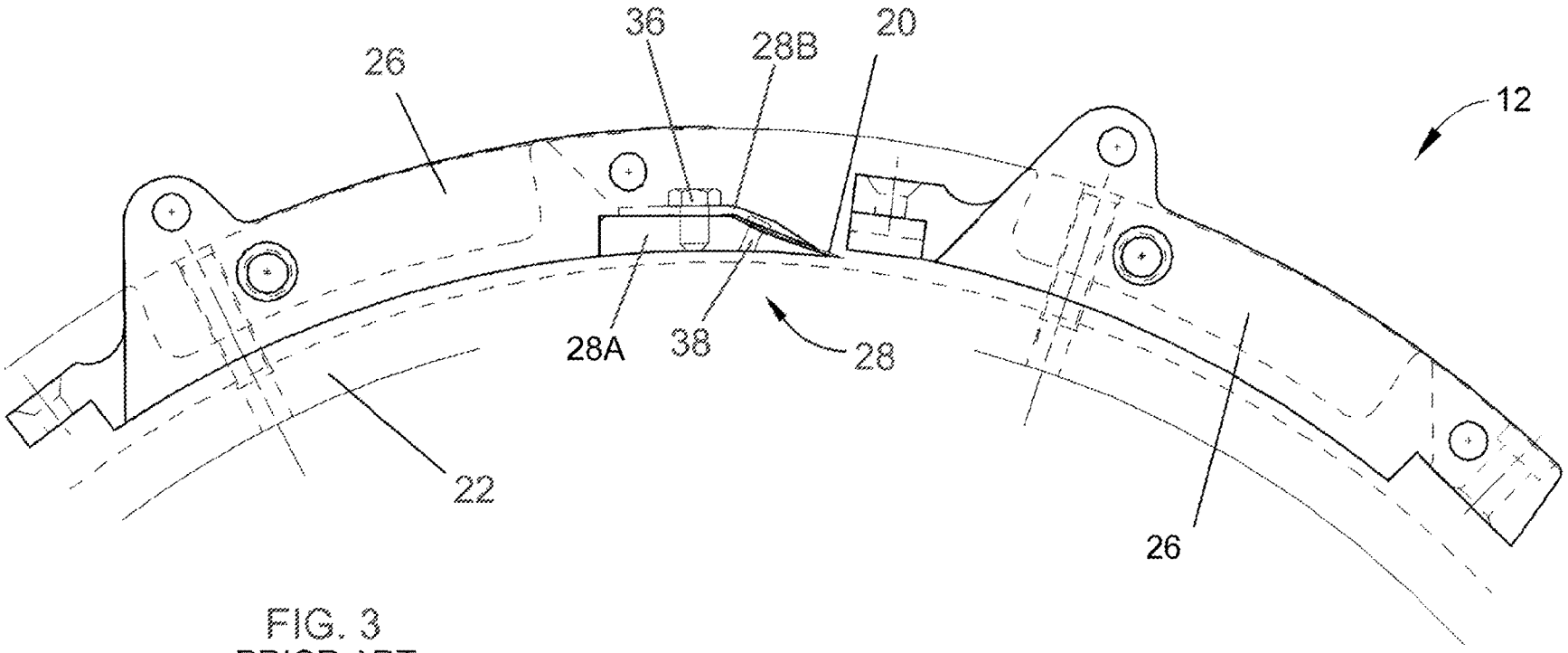
FIG. 3 PRIOR ART
FIG. 3 is a bottom view showing a fragment of the cutting head of FIG. 2.
Figure 4:
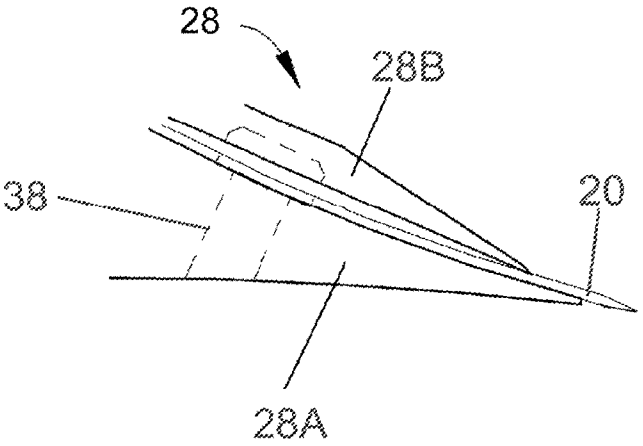
FIG. 4 PRIOR ART
FIG. 4 is a detailed view of a portion of a knife assembly of the cutting head.

FIGS. 6 through 10 schematically represent portions of a knife assembly 50 at which the cutting edge 54 of a knife 52 is located. As with the knife assemblies 28 and 40 represented in FIGS. 2 through 5, the knife assembly 50 includes a knife holder 56 adapted to be mounted to the radially inward-facing side of a shoe (for example, a shoe 26 of the cutting head 12 in FIG. 2), and a clamp 58 on the radially outward-facing side of the knife holder 56 that secures the knife 52 to the knife holder 56. Similar to the knife holder 28A and clamp 28B seen in FIG. 2, the knife holder 56 and clamp 58 can be configured so that their longitudinal lengths extend parallel to the axis of the cutting head in which they are installed. The clamping action on the knife 52 can be the result of the clamp 58 being secured to the knife holder 56 with fasteners (for example, as shown in FIGS. 2 and 3), or the result of a quick-clamping assembly, a nonlimiting example of which is disclosed in U.S. Pat. Nos. 7,658,133 and 8,161,856, whose contents are incorporated herein by reference.

The knife holder 56 includes an insert 60 that supports the knife 52 near its cutting edge 54 and serves to protect the leading edge 62 of the knife holder 56 from stones or other debris that the edge 62 may encounter. The insert 60 is supported on a recessed support surface 64 of the knife holder 56 that extends to and along at least a portion of the leading edge 62 of the holder 56. The insert 60 protrudes beyond the leading edge 62 of the holder 56 so that a leading end 66 of the insert 60 supports the knife 52 near its cutting edge 54. The leading end 66 of the insert 60 is preferably beveled, in some cases defined by a single bevel at or near the leading edge of the insert 60. The nonlimiting embodiment of the insert 60 shown in the drawings has a pair of beveled surfaces 68 and 70 that form the leading end 66 of the insert 60. The beveled surface 68 is represented as being approximately coplanar with a radially-inward surface 71 of the knife holder 56 that is oppositely disposed from the support surface 64 of the knife holder 56. The leading end 66 of the insert 60 serves as a replaceable leading edge for the knife holder 56. If the cutting edge 54 of the knife 52 requires replacement due to damage (for example, chipping, cracking, wear, etc.), the leading end 66 of the insert 60 will likely also exhibit damage and require replacement. However, the knife holder 56 is less likely to need replacement because the insert 60 has sustained the impact from objects that might otherwise damage the knife holder 56.

Figure 5:
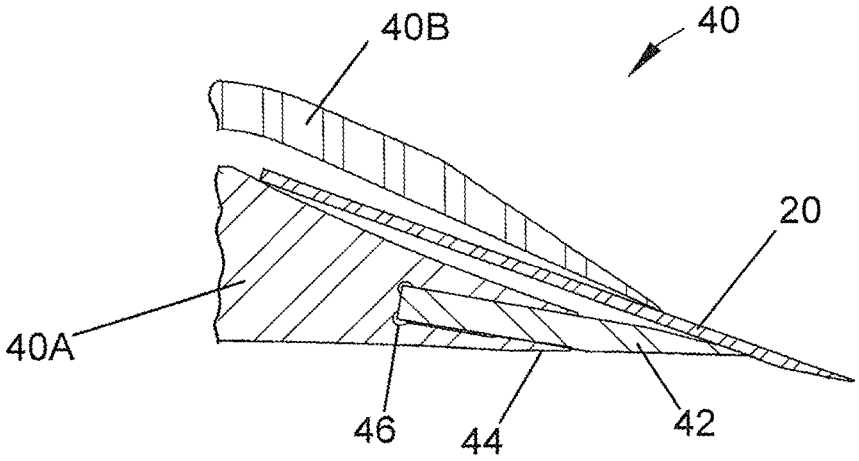
FIG. 5 PRIOR ART
FIG. 5 is a cross-sectional view of an alternative knife assembly capable of use with the cutting head of FIG. 2.
Figure 6:
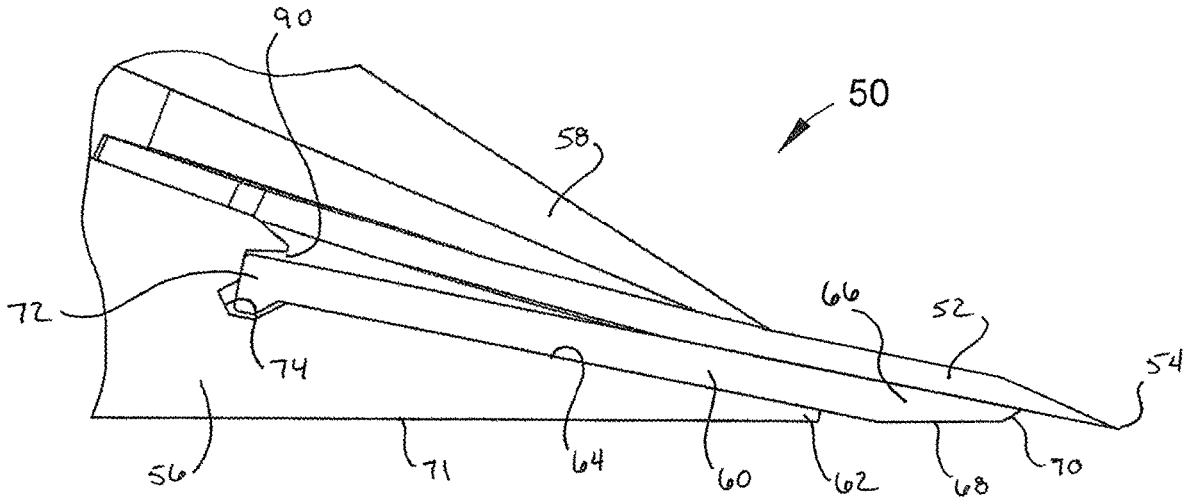
FIG. 6 is a cross-sectional view of a knife assembly capable of use with the cutting head of FIG. 2 in accordance with a nonlimiting embodiment of the invention.
Figure 7:
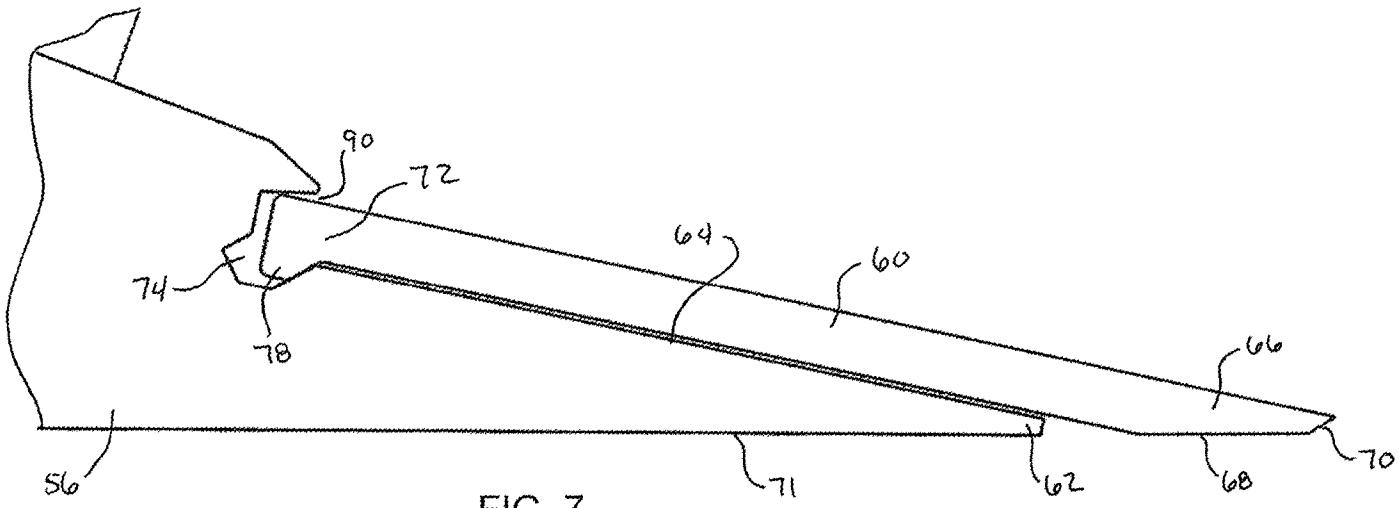
FIG. 7 is a side view showing in isolation a portion of a knife holder and an insert of the knife assembly of FIG. 6, and showing the insert in an installed position within a slot of the knife holder.

FIG. 6 shows a trailing end 72 of the insert 60 as received in a slot 74 located at a trailing end of the recessed support surface 64 of the knife holder 56. The trailing end of the support surface 64 is generally parallel to and spaced from the leading edge 62 of the knife holder 56. The slot 74 defines an opening 90 that is contiguous with the support surface 64 and its trailing end. Similar to the slot 46 shown in FIG. 5, the slot 74 is oriented to be generally parallel to the longitudinal length of the knife holder 56, and also parallel to the leading edge 62 of the knife holder 56. In contrast to what is depicted in FIG. 5, neither the slot 74 nor the trailing end 72 of the insert 60 received in the slot 74 has a rectangular cross-sectional shape. Instead, the trailing end 72 and slot 74 have cross-sectional shapes and are sized to retain the insert 60 within the slot 74. As evident from FIGS. 6 through 8 and 10, the trailing end 72 of the insert 60 has a generally rectangular profile 76 (FIG. 10) from which a locking feature projects from a radially-inward facing surface 80 of the insert 60. The locking feature is depicted as a protrusion 78 that may be a continuous rib that extends along the entire trailing end 72 of the insert 60, or may be two or more separate ribs located at the trailing end 72 of the insert 60.

In the nonlimiting embodiment shown in FIGS. 6 through 8 and 10, the protrusion 78 is contiguous with the edge of the trailing end 72 of the insert 60. The location of the protrusion 78 enables the trailing end 72 of the insert 60 to interlock with the slot 74 of the knife holder 56, as evident from FIG. 8 in which the insert 60 is shown in two extreme orientations relative to the knife holder 56 and yet its trailing end 72 is retained in the slot 74. As perhaps most evident from FIG. 9, the slot 74 is defined by two diverging portions 82 and 84 that extend away from the leading edge 62 of the knife holder 56. The diverging portion 82 is represented in FIGS. 6 through 9 as extending in a direction roughly parallel to the surface 71 of the knife holder 56 opposite its recessed support surface 64, and the diverging portion 84 is represented in FIGS. 6 through 9 as extending at an acute angle to the diverging portion 82, for example, in a direction roughly 30 degrees to diverging portion 82, though other orientations for the diverging portions 82 and 84 are foreseeable. From FIG. 6 it can be seen that the protrusion 78 of the insert 60 is generally received in the diverging portion 84 of the slot 74 when the insert 60 is clamped to the knife holder 56 by the clamp 58. As evident from FIG. 9, the diverging portions 82 and 84 can be machined into the knife holder 56 using conventional machining tools (not shown) oriented along, respectively, one of two planes 86 and 88. The plane 86 is shown roughly parallel to the surface 71 of the knife holder 56, whereas the plane 88 is shown as oriented roughly 30 degrees to the plane 86. From FIG. 9, it should be apparent that the slot 74 can be manufactured using conventional machining methods.

Figure 8:
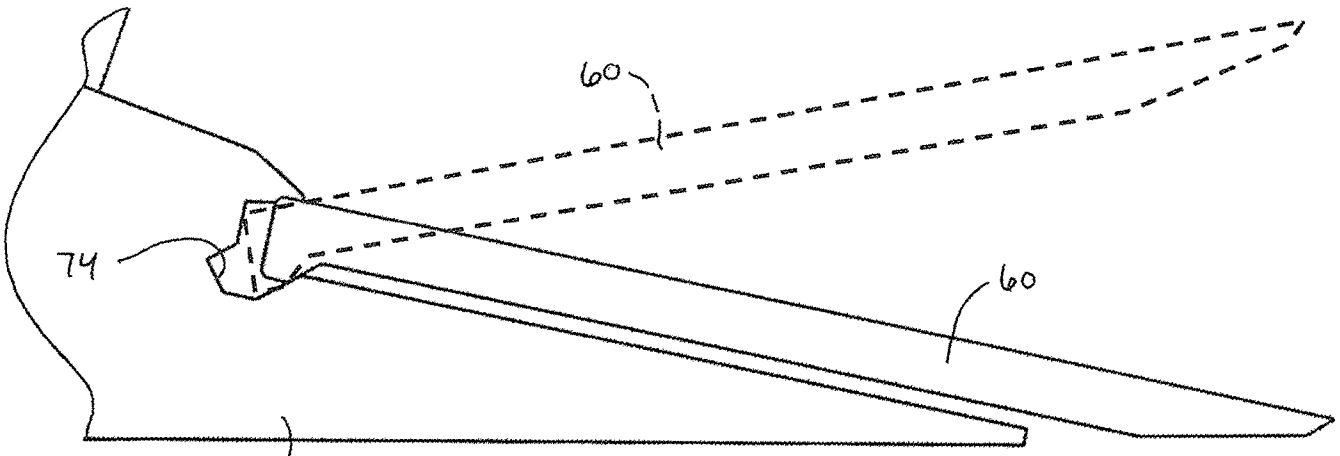
FIG. 8 shows two orientations of the insert of FIGS. 6 and 7 in which the insert is displaced from the installed position of FIG. 7 and yet retained in the slot.
Figure 9:
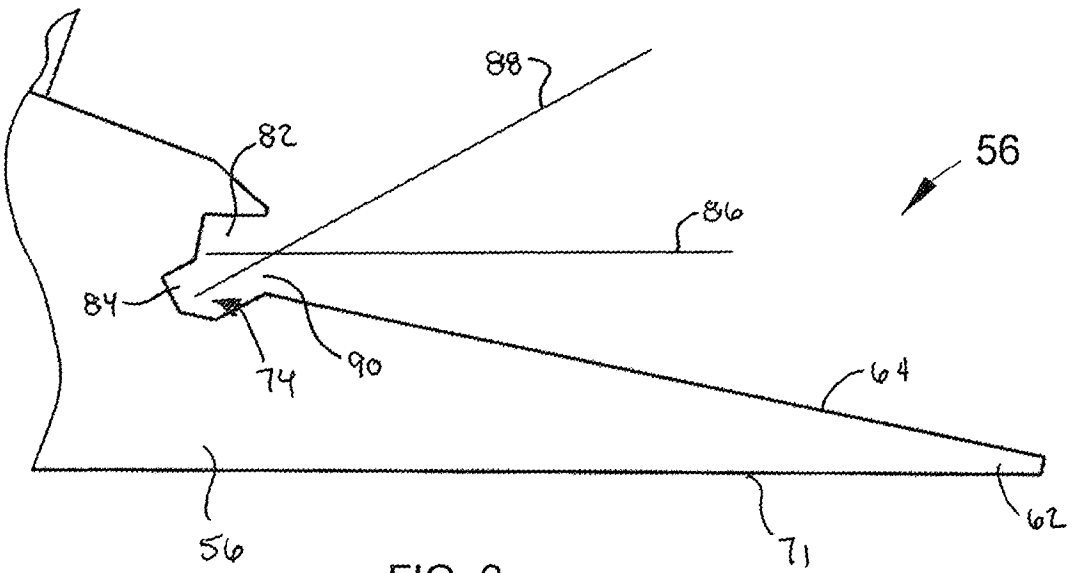
FIG. 9 represents orientations of a machining tool for machining the slot in the knife holder of FIGS. 6 through 8.
Figure 10:
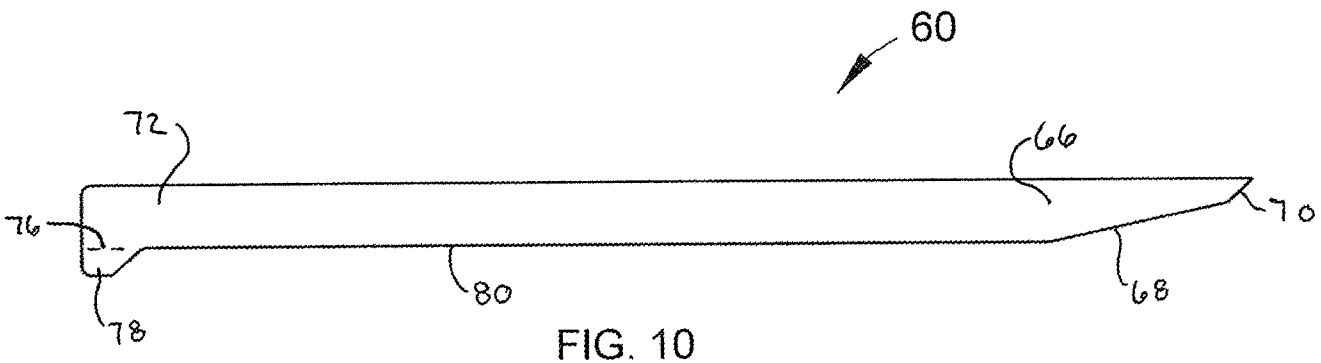
FIG. 10 is a side view showing in isolation the insert of FIGS. 6 through 8.

The shapes of the trailing end 72 of the insert 60 and the slot 74 in the knife holder 56 are such that the trailing end 72 is able to freely slide in directions parallel to the slot 74, but cannot be dislodged from the slot 74 by moving the insert 60 in any other direction (including perpendicular) to the slot 74, as evident from FIG. 8. In particular, the minimum width or thickness of the insert 60 as defined by the protrusion 78 at its trailing end 72 is greater than the maximum width of the opening 90 to the slot 74. As a result, the insert 60 can be quickly assembled to the knife holder 56 and will remain reliably secured to the knife holder 56 during the operation of a machine in which the knife assembly 50 is installed. The asymmetric configuration of the trailing end 72 of the insert 60 also preferably prevents the insert 60 from being incorrectly installed in the knife holder 56. With an arrangement of the type represented in FIGS. 6 through 10, once the clamping force is released from the knife 52, the insert 60 can be readily removed from the knife holder 56 by sliding the insert 60 parallel to the length of the slot 74, in other words, generally parallel to the longitudinal length of the knife holder 56.

Figure 12:
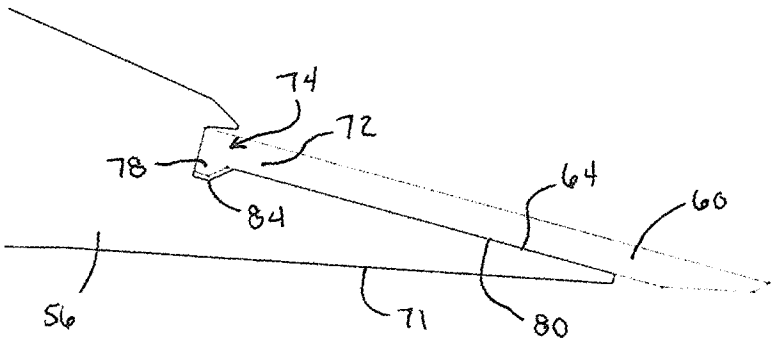
FIGS. 11 and 12 are side views showing, respectively, a portion of an alternative knife holder capable of use with the cutting head of FIG. 2 and the insert of FIGS. 6 through 8 and 10 assembled with the knife holder in accordance with another nonlimiting embodiment of the invention.
Figure 11:
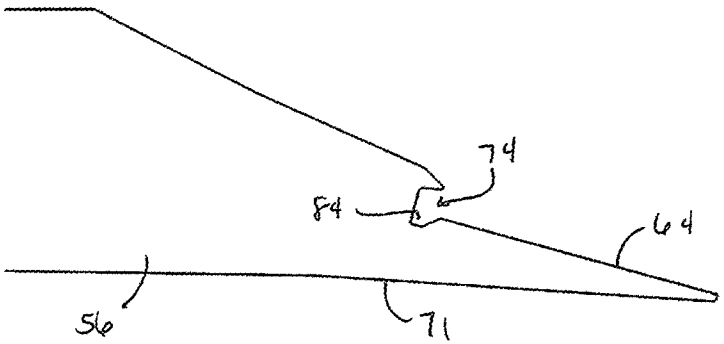
Figure 14:
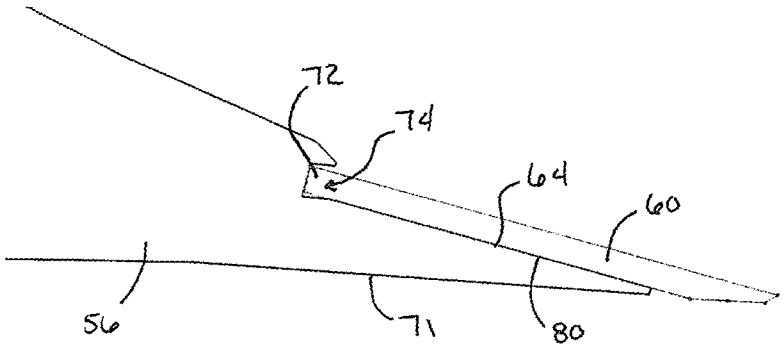
FIGS. 13 and 14 are side views showing, respectively, a portion of another alternative knife holder capable of use with the cutting head of FIG. 2 and an alternative insert assembled with the knife holder in accordance with yet another nonlimiting embodiment of the invention.
Figure 13:
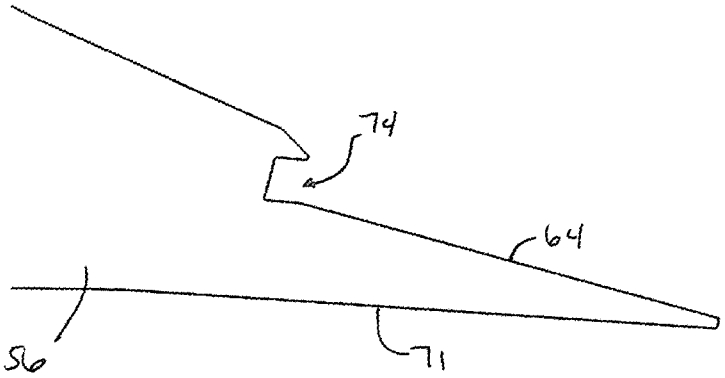
Figure 15:
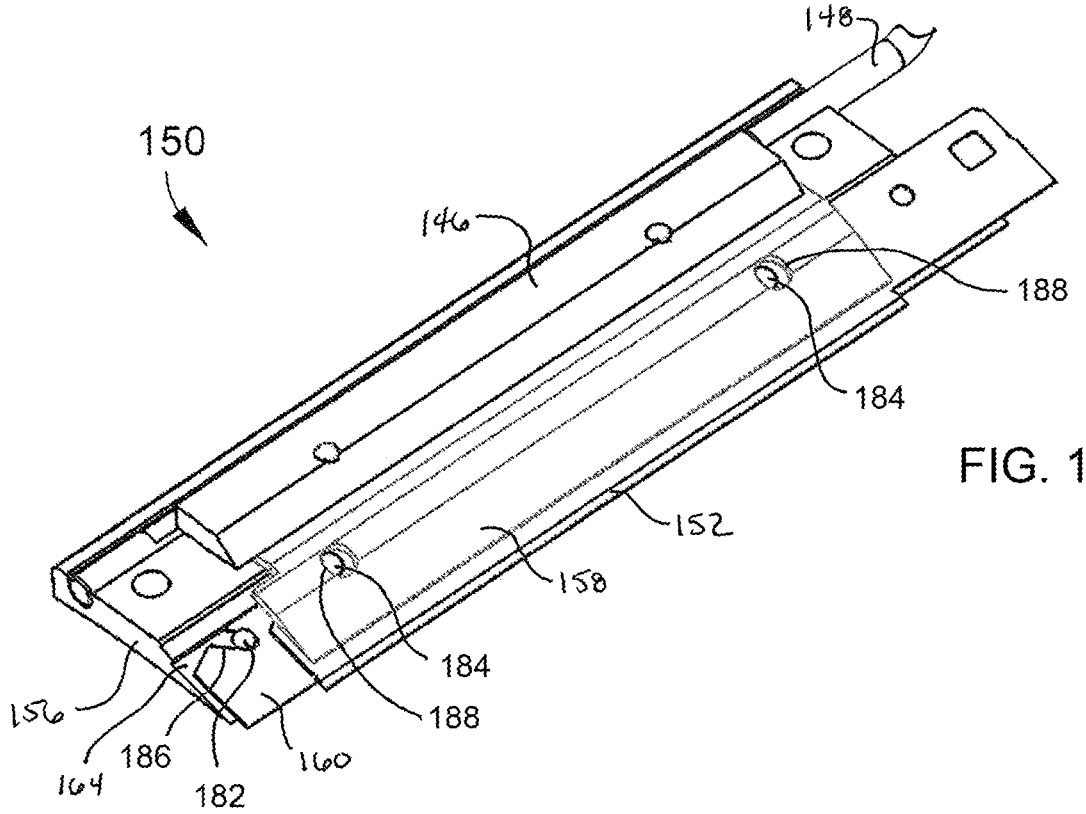
FIG. 15 is a perspective view of a knife assembly capable of use with the cutting head of FIG. 2 in accordance with still another nonlimiting embodiment of the invention.
Figure 16:
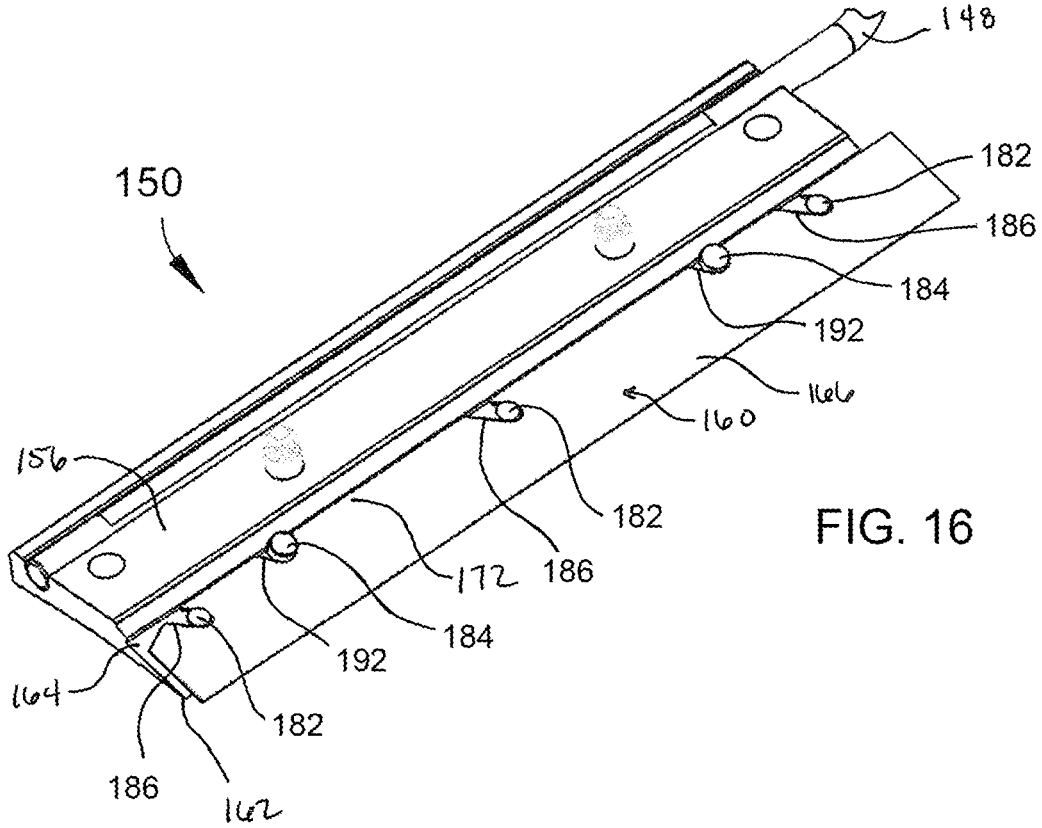
FIG. 16 is a perspective view of the knife assembly of FIG. 15 with a clamp and clamping bar omitted to reveal the manner in which an insert is secured to a knife holder of the knife assembly.
Figure 17:
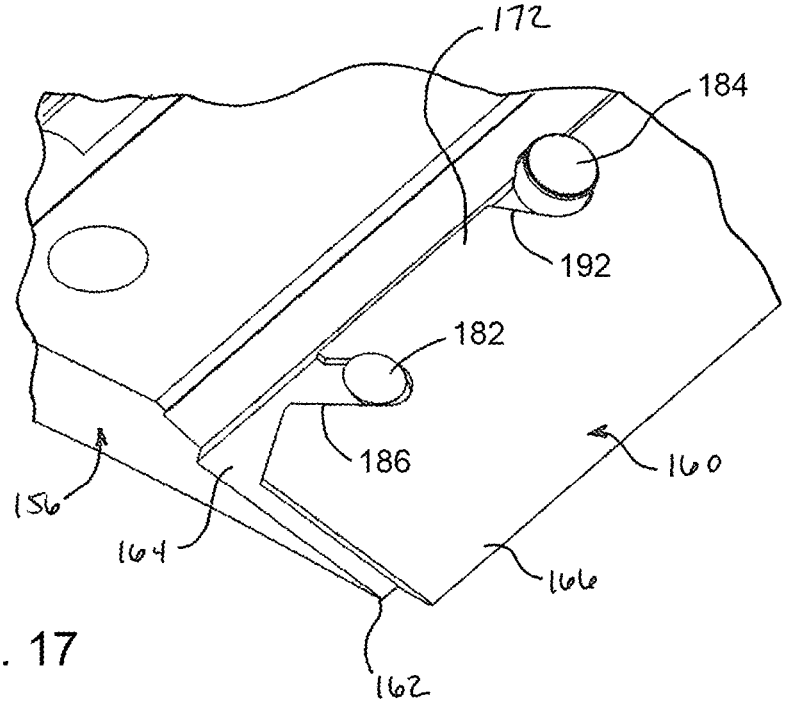
FIG. 17 is a detailed perspective view of portions of the insert and knife holder of FIG. 16.

FIGS. 11 and 13 represent two additional nonlimiting embodiments for the knife holder 56 shown in FIGS. 6 through 9, FIG. 12 depicts the insert 60 of FIGS. 6 through 8 and 10 installed in the knife holder 56 of FIG. 11, and FIG. 14 depicts an alternative insert 60 installed in the knife holder 56 of FIG. 13. In FIGS. 11 and 12, the slot 74 has a cross-sectional shape that is generally complementary and more congruent to the cross-sectional shape of the trailing end 72 of the insert 60, and the protrusion 78 of the insert 60 will generally be within the portion 84 of the slot 74 when the insert 60 is clamped to the knife holder 56. The embodiment of FIGS. 11 and 12 provides for interlocking of the insert 60 and knife holder 56 essentially as described for the embodiment of FIGS. 6 through 10, whereas an interlocking capability is not provided in the embodiment of FIGS. 13 and 14. The insert 60 shown in FIG. 14 lacks the protrusion 78 of the previous embodiments, and the slot 74 and insert 60 of FIGS. 13 and 14 generally have complementary rectangular cross-sectional shapes. The slots 74 of the knife holders 56 shown in FIGS. 11 through 14 can be manufactured using conventional machining methods.

FIGS. 15 through 18 schematically represent another embodiment of a knife assembly 150 that enables an insert 160 to be readily removed from a knife holder 156 once a clamping force is released from a knife 152 clamped to the knife holder 156 by a clamp 158. In view of similarities between the embodiments, the following discussion of FIGS. 15 through 18 will focus primarily on aspects that differ from the embodiments of FIGS. 6 through 14 in some notable or significant manner. Other aspects of the embodiment of FIGS. 15 through 18 that are not discussed in any detail can be, in terms of structure, function, materials, etc., essentially as was described for the embodiments of FIGS. 6 through 14.

The knife assembly 150 is represented as a quick-clamping knife assembly of a type disclosed in U.S. Pat. Nos. 7,658,133 and 8,161,856, wherein an eccentric clamping rod 148 is disposed within a recess formed in a surface of the knife holder 156 and is situated between and contacts the knife holder 156 and clamp 158. The rod 148 can be rotated within the recess between clamping and release positions, which serve to secure and release, respectively, the knife 152 in cooperation with a clamping bar 146 that acts as a fulcrum to force the clamp 158 into engagement with the knife 152.

In place of the insert 60 configured to cooperate with the slot 74 of FIGS. 6 through 10, the insert 160 of FIGS. 15 through 18 is secured to the knife holder 156 with locking studs or posts 182 that protrude from a recessed support surface 164 of the knife holder 156 and engage keyhole-shaped slots 186 formed in a trailing end 172 of the insert 160, located on an opposite side of the insert 160 from a leading end 166 of the insert 160. The posts 182 protrude from the knife holder 156 and engage the slots 186 in the insert 160 to position the insert 160 on the recessed support surface 164 of the knife holder 156 so that the leading end 166 of the insert 160 extends beyond the leading edge 162 of the holder 156. The knife holder 156 also has locating pins 184 that protrude from the recessed support surface 164 of the knife holder 156 and engage aligned holes 188 (FIG. 15) in the knife 152 and clamp 158 to position the knife 152 on the knife holder 156. The insert 160 is formed to have recesses 192 in its trailing end 172 through which the pins 184 pass before engaging the aligned holes 188 in the knife 152 and clamp 158.

Figure 18:
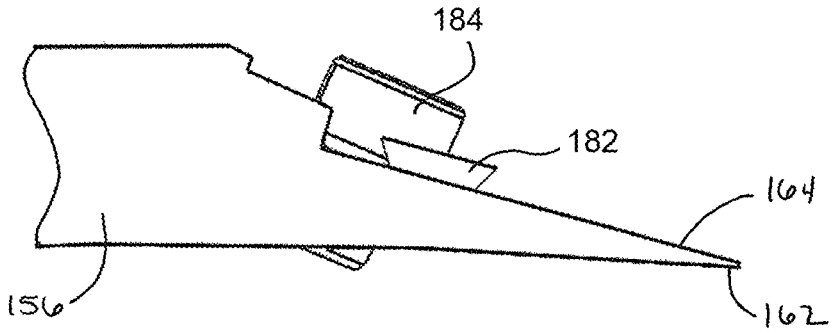
FIG. 18 is an isolated side view of the knife holder of FIGS. 15 through 17.

As seen in FIG. 18, the posts 182 that engage the slots 186 of the insert 160 may have an inverted frustoconical shape to create an interference gripping engagement with the slots 186 of the insert 160 to promote the retention of the insert 160 on the recessed support surface 164 of the knife holder 156. The pins 184 that engage the aligned holes 188 of the knife 152 and clamp 158 are not shown to have an inverted frustoconical shape, and a diametrical clearance preferably exists between the pins 184 and the recesses 192 of the insert 160. The shapes and orientation of the slots 186 in the trailing end 172 of the insert 160 are such that the trailing end 172 cannot be dislodged from the posts 182 other than by moving the insert 160 in a diagonal direction (other than parallel or perpendicular) to the longitudinal length of the knife holder 156. As such, the insert 160 can be quickly assembled to the knife holder 156 and will remain reliably secured to the knife holder 156 during the operation of a machine in which the knife assembly 150 is installed, and the diagonal orientations of the slots 186 at the trailing end 172 of the insert 160 prevent the insert 160 from being incorrectly installed in the knife holder 156. With an arrangement of the type represented in FIGS. 15 through 18, once the clamping force is released from the knife 152, the insert 160 can be readily removed from the knife holder 156 by sliding the insert 160 diagonally to the longitudinal length of the knife holder 156.

FIGS. 19A through 23B contain various views of knife holders and/or inserts of further alternative knife assemblies capable of use with the cutting head of FIG. 2 in accordance with additional nonlimiting embodiments of the invention. The following discussions relating to FIGS. 19A through 23B will focus primarily on aspects that differ from the embodiments of FIGS. 6 through 18 in some notable or significant manner, and aspects not discussed in any detail can be, in terms of structure, function, materials, etc., essentially as was described for the embodiments of FIGS. 6 through 18.

FIGS. 19A through 19D, 20A, and 20B depict knife holders 256 that share as a common feature slots 274 within the knife holders 256 whose openings 290 (labeled in FIG. 20B) are at or adjacent the leading edge 262 of the holder 256, in contrast to the recessed support surfaces 64 and 164 depicted for the previous embodiments. The knife holders 256 are configured for use in combination with inserts 260 whose trailing ends 272 are received in the slots 274, such that roughly half of the width of each insert 260 (transverse to its longitudinal length) protrudes beyond the leading edge 262 of the holder 256 so that a leading end 266 of the insert 260 is capable of supporting a knife (not shown) near the cutting edge thereof. In this regard, the knife holders 256 and inserts 260 share similarities with that shown in FIG. 5.

Figure 19A:
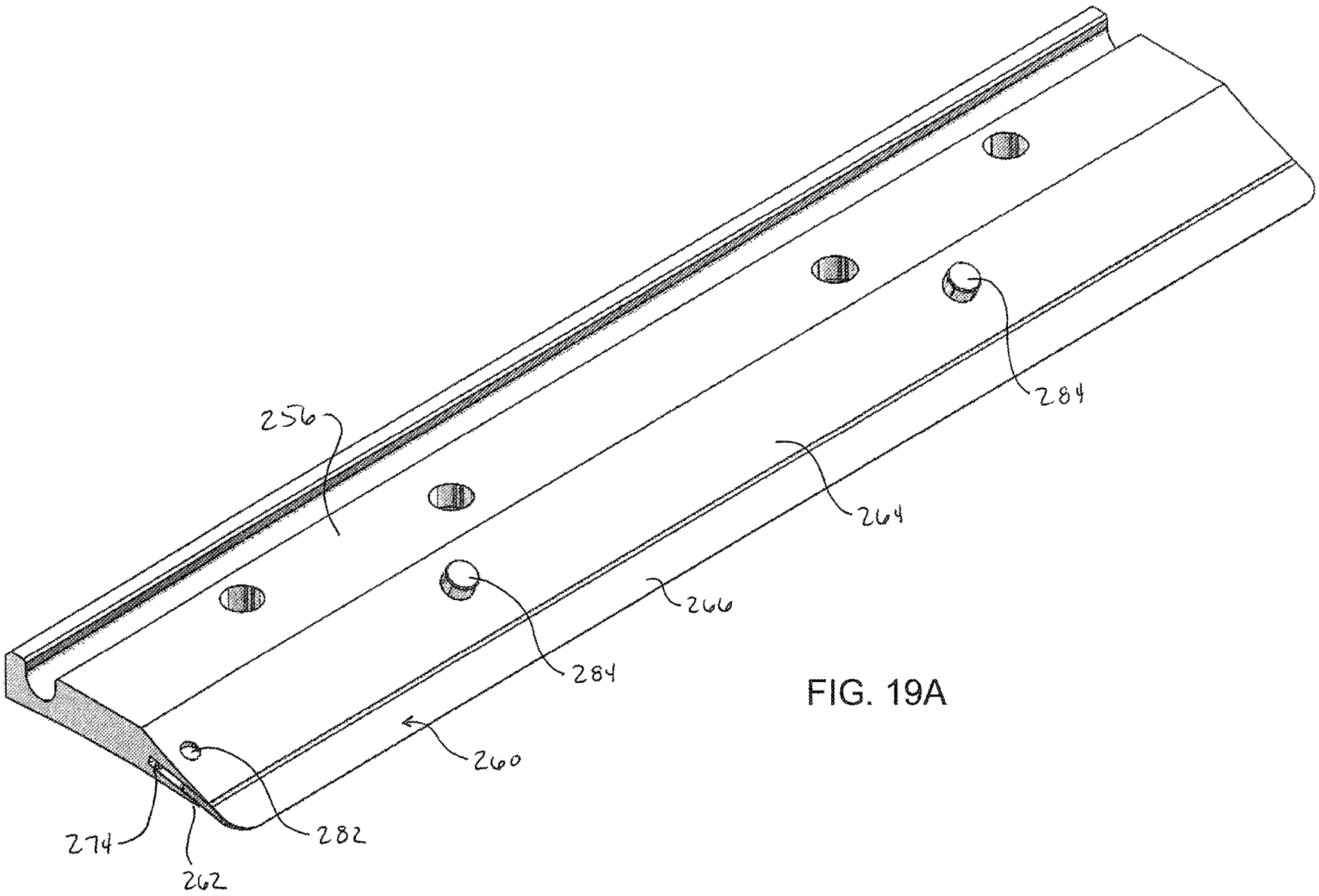
FIGS. 19A through 23B contain various views of knife holders and/or inserts of further alternative knife assemblies capable of use with the cutting head of FIG. 2 in accordance with additional nonlimiting embodiments of the invention.
Figure 19B:
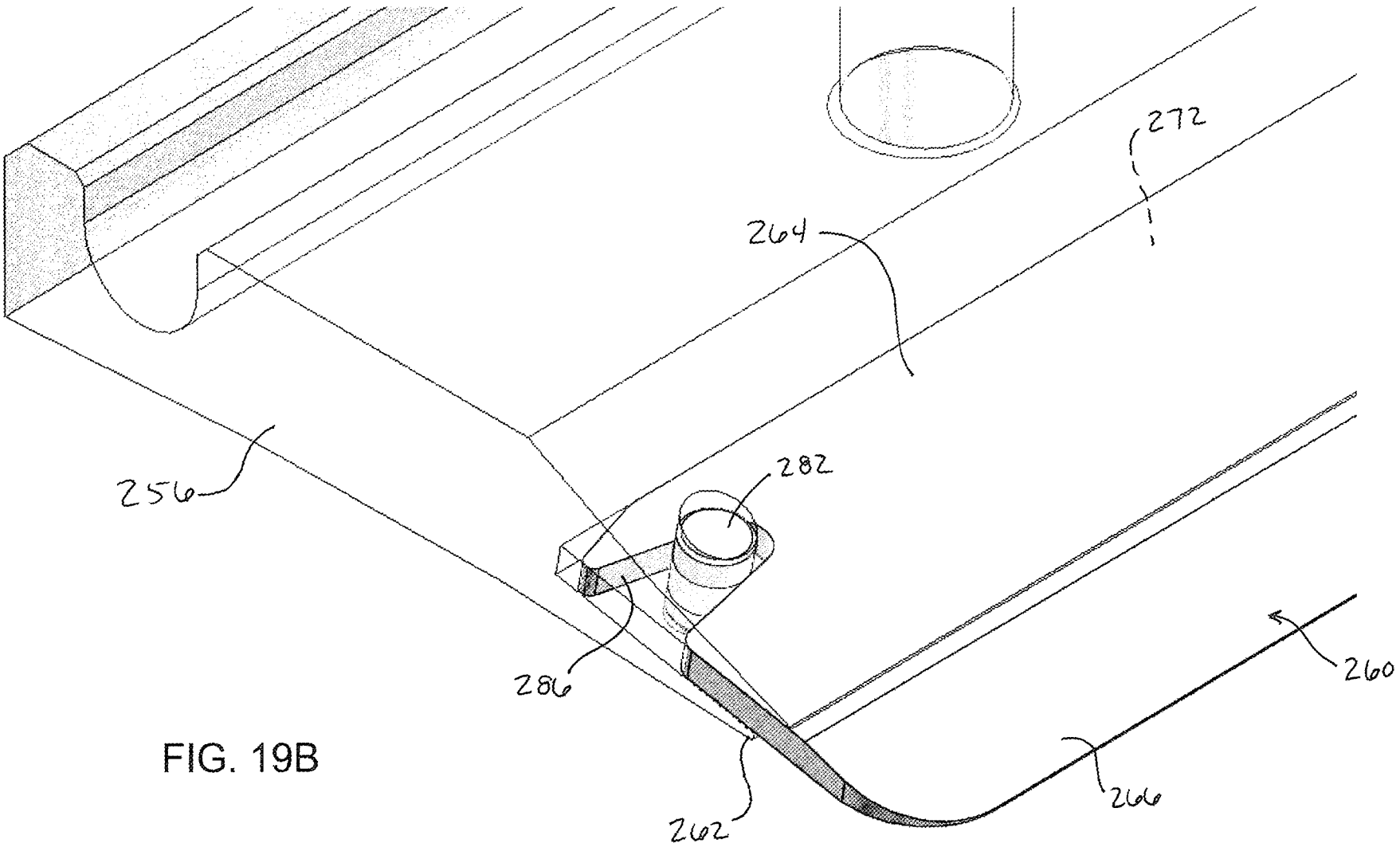
Figure 19C:
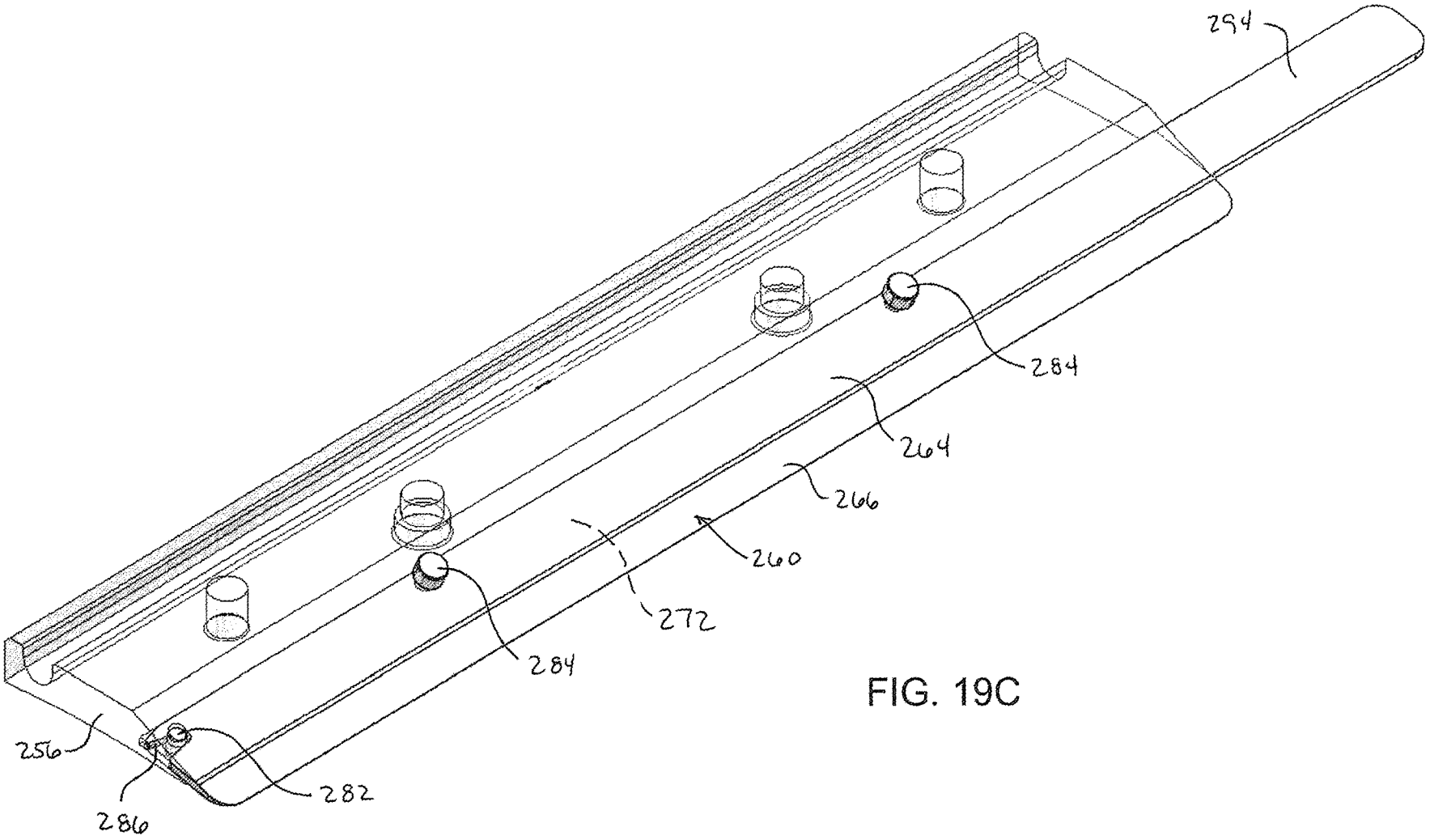
Figure 19D:
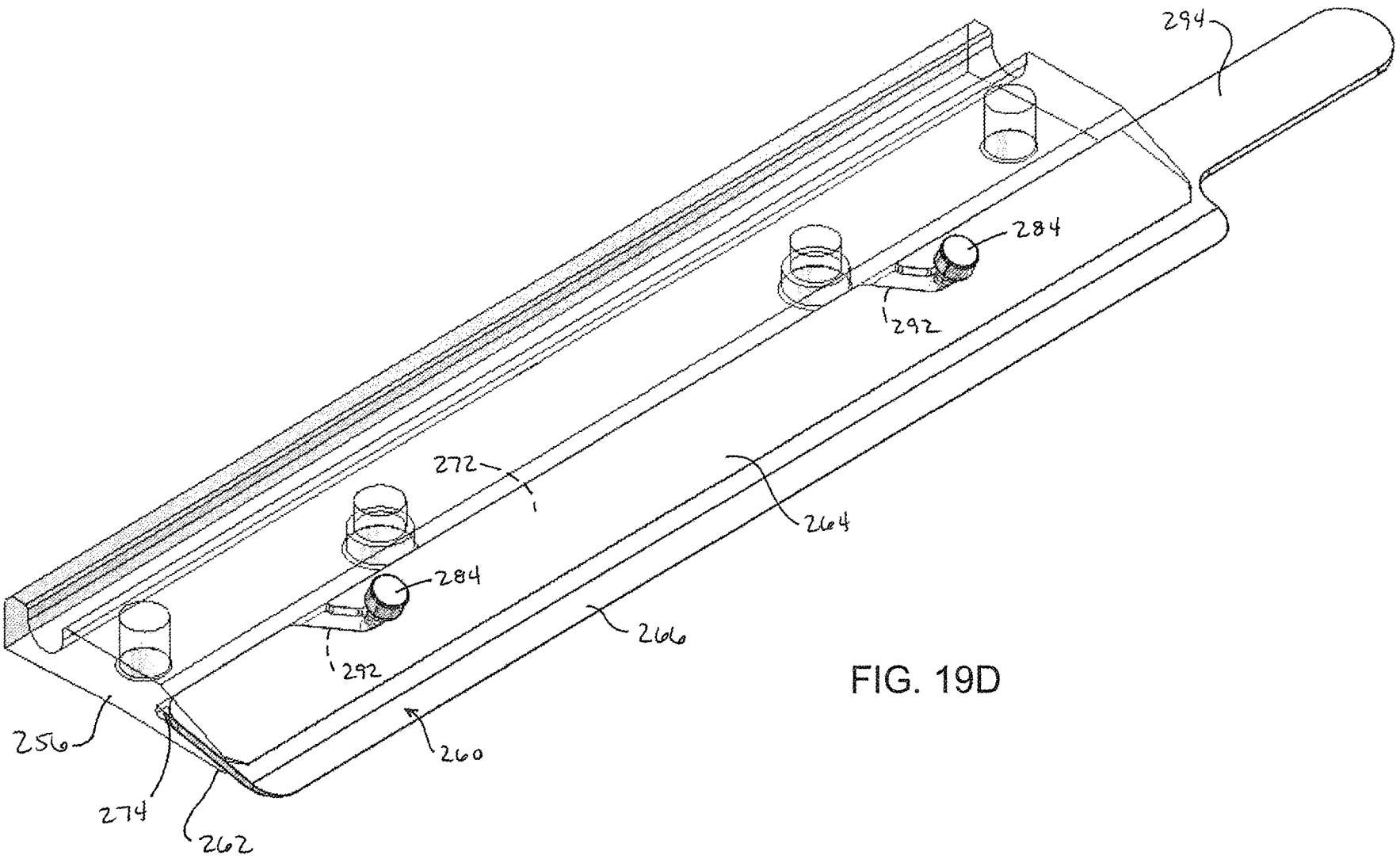

Referring to FIGS. 19A through 19C, the insert 260 is secured to the knife holder 256 with a slot 286 that is located at a longitudinal end 287 (FIG. 19B) of the insert 260 between its leading and trailing ends 266 and 272. The slot 286 engages a locking stud or post 282 that passes through the slot 274 adjacent the corresponding end of the slot 274, such that the insert 260 is effectively positioned within the slot 274 of the knife holder 256 so that its leading end 266 extends beyond the leading edge 262 of the holder 256. The knife holder 256 also has locating pins 284 that protrude from a support surface 264 of the knife holder 256 so as to be able to engage alignment holes in a knife clamped to the surface 264 of the holder 256. The insert 260 may be formed to have an extension 294 (FIGS. 19C and 19D) capable of serving as a handle to facilitate insertion and removal of the insert 260 on the knife holder 256. As shown in FIG. 19D, in addition or as an alternative to the locking post 282 and slot 286, the insert 260 may be formed to have keyhole-shaped slots 292 in its trailing end 272 that interlock with the locating pins 284, which as evident in FIG. 19D combines the functions of the locking posts 282 and locating pins 284 of FIGS. 19A through 19C.

Figure 20A:
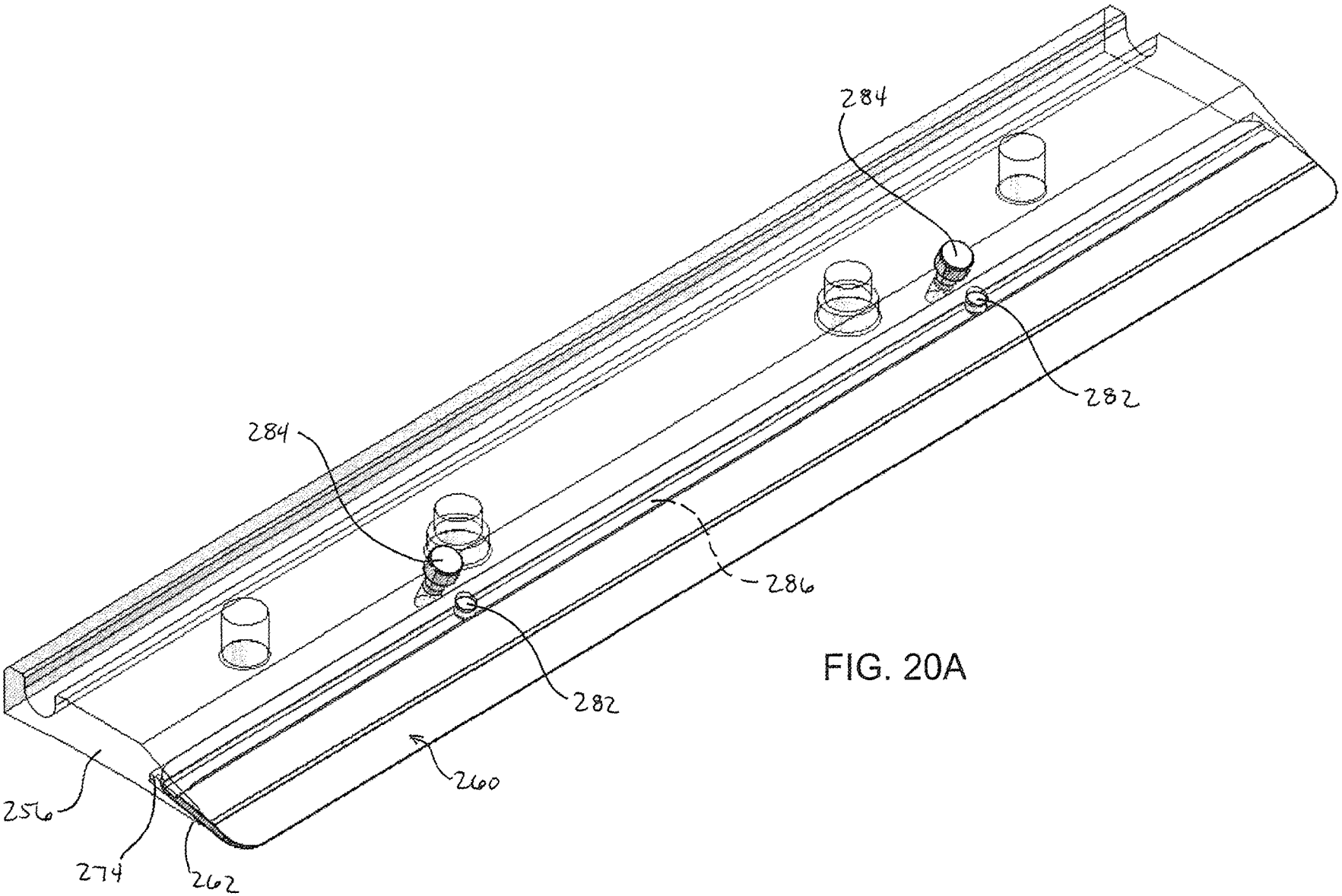
Figure 20B:
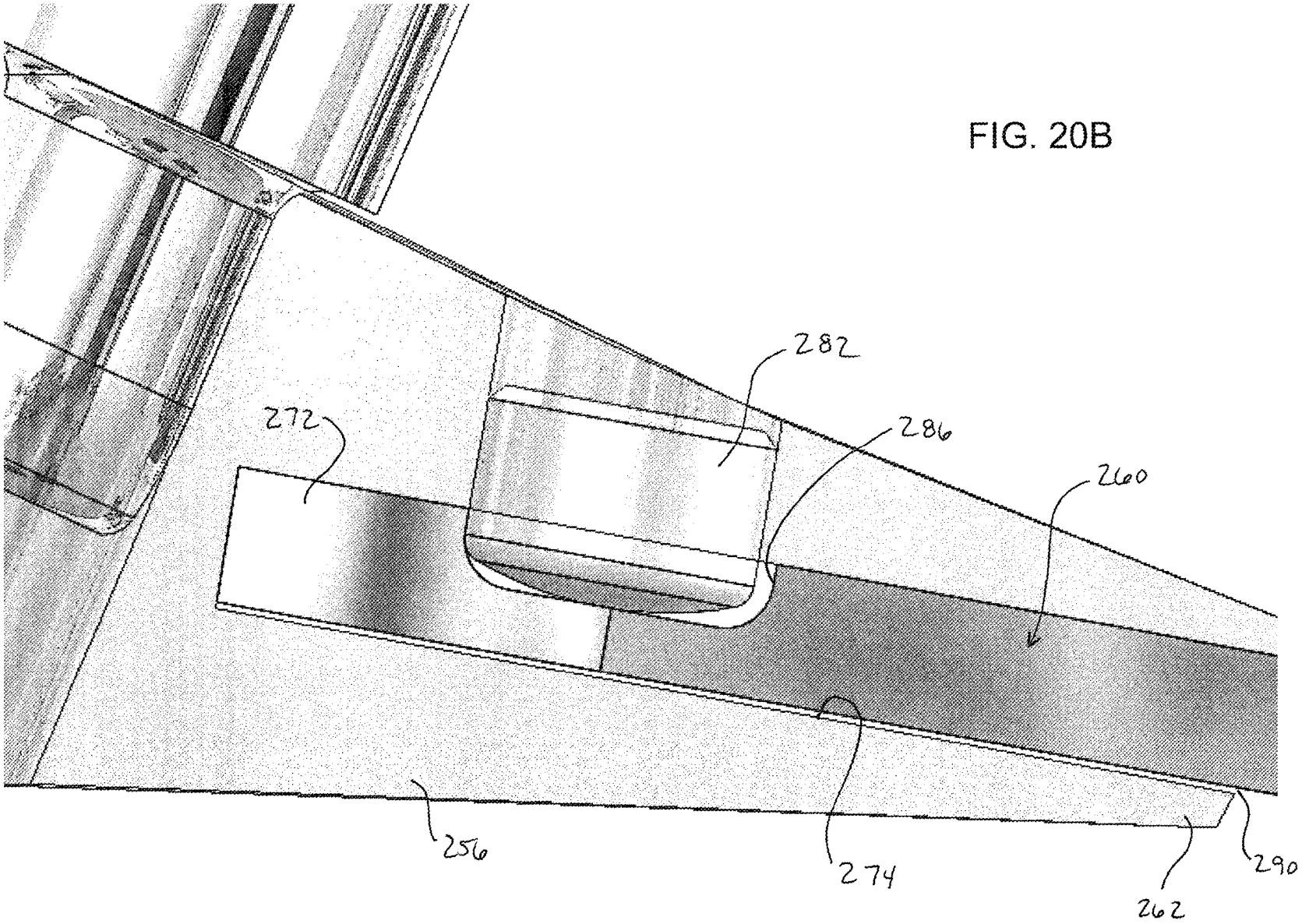

FIGS. 20A and 20B depict another alternative in which the slot 286 formed in the insert 260 has been reconfigured and relocated as a channel or groove that extends longitudinally along the trailing end 272 of the insert 260 and is engaged by one or more locking studs or posts 282 that protrude into the slot 274 of the knife holder 256, such that the insert 260 is effectively positioned and locked within the slot 274.

FIGS. 21A through 23B depict knife holders 356 that share as a common feature recessed support surfaces 364 for supporting an insert 360, and the absence of a slot into which the trailing ends 372 of the inserts 360 are secured. The knife holders 356 are configured so that a leading end 366 of the insert 360 sufficiently protrudes beyond a leading edge 362 of the knife holder 356 to support a knife 352 near the cutting edge 354 thereof. In this regard, the knife holders 356 and inserts 360 share similarities with those shown in FIGS. 6 through 10.

Figure 21A:
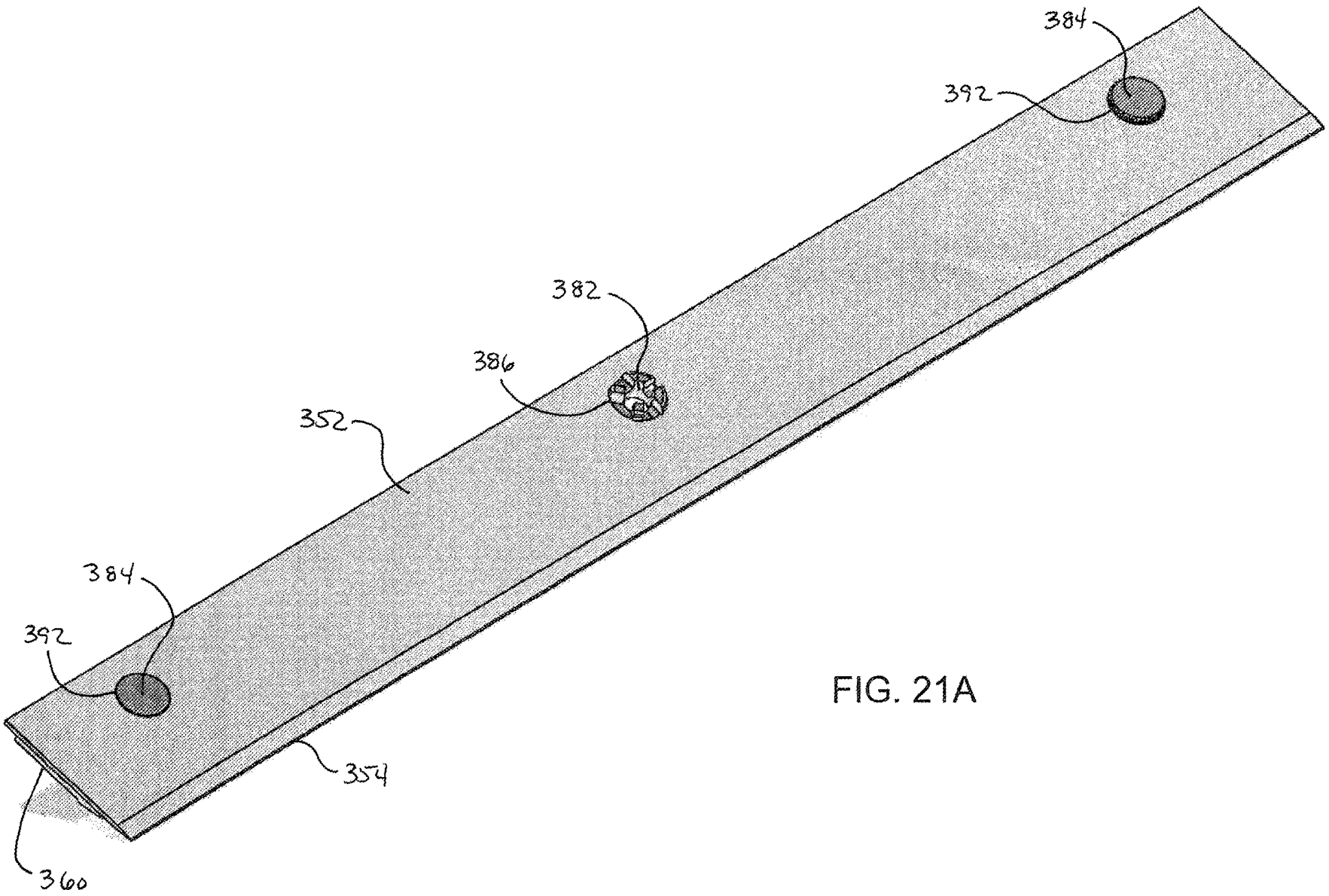
Figure 21B:
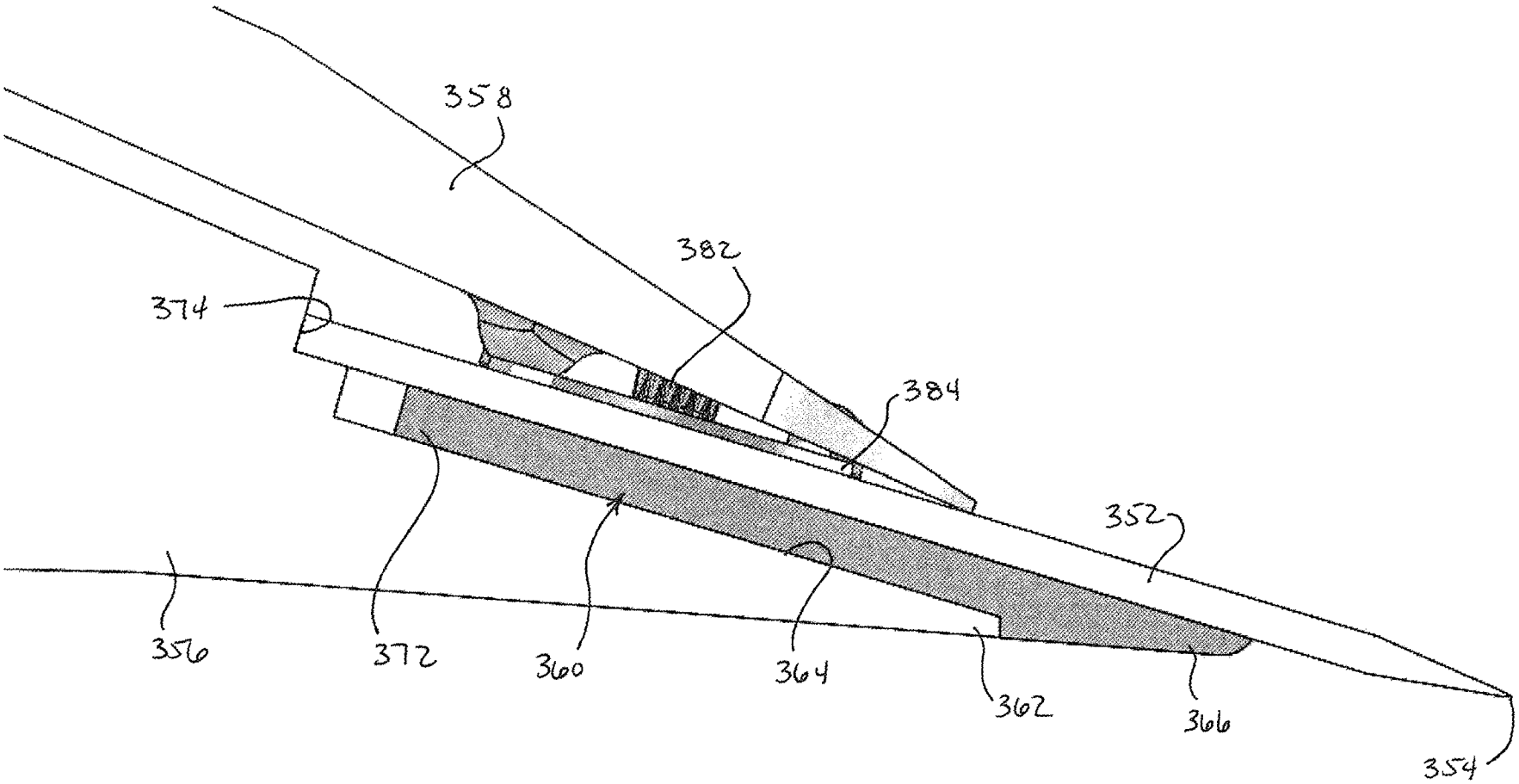

Referring to FIGS. 21A and 21B, the insert 360 is directly secured to the knife 352, and the resulting assembly is then secured to the recessed support surface 364 of the knife holder 356 with a clamp 358, for example, as described in reference to FIGS. 6 through 10 and/or FIGS. 15 through 18. As evident from FIG. 21B, the insert 360 is formed to have at least one locking stud or post 382 that engages and interlocks with a hole 386 in the knife 352. The insert 360 is also formed to have one or more locating pins 384 that protrude from the insert 360 and engage complementary holes 392 in the knife 352, such that the insert 360 and knife 352 are immovable relative to each other. As seen in FIG. 21B, the recessed support surface 364 of the knife holder 356 defines a trailing end against which the edge of the knife 352 opposite its cutting edge 354 abuts to positively and accurately position the knife cutting edge 354 relative to the knife holder 356.

Figure 22A:
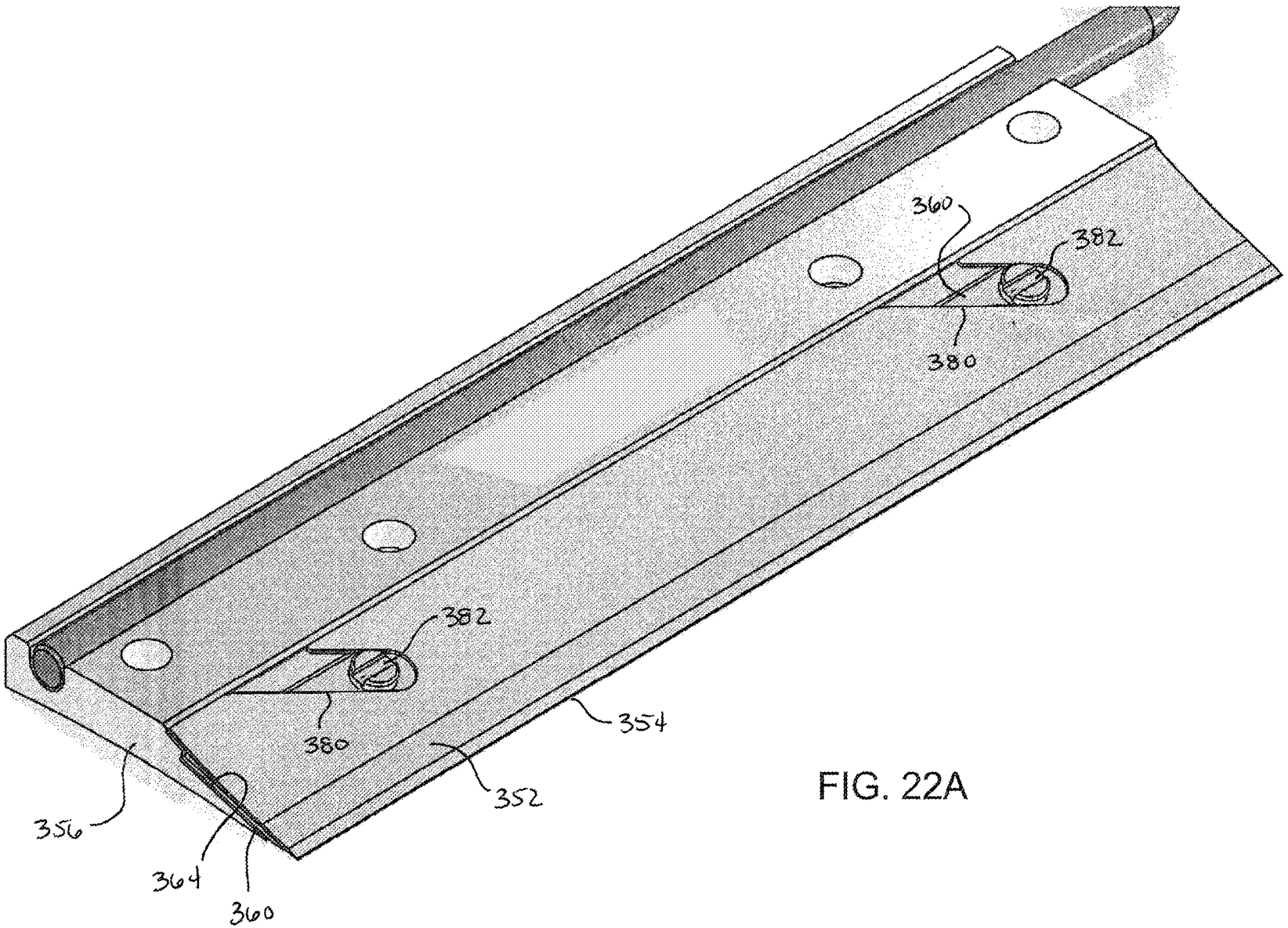
Figure 22B:
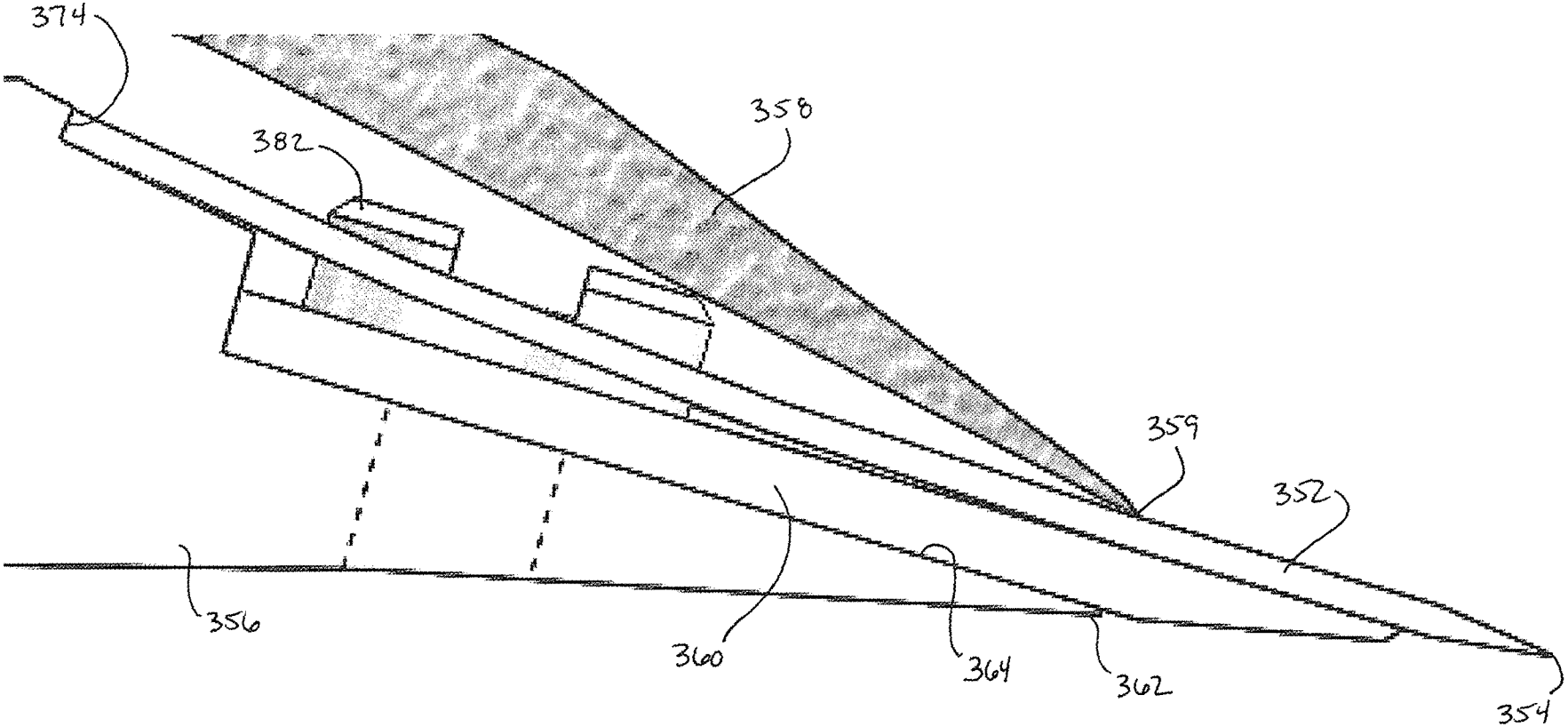
Figure 22C:
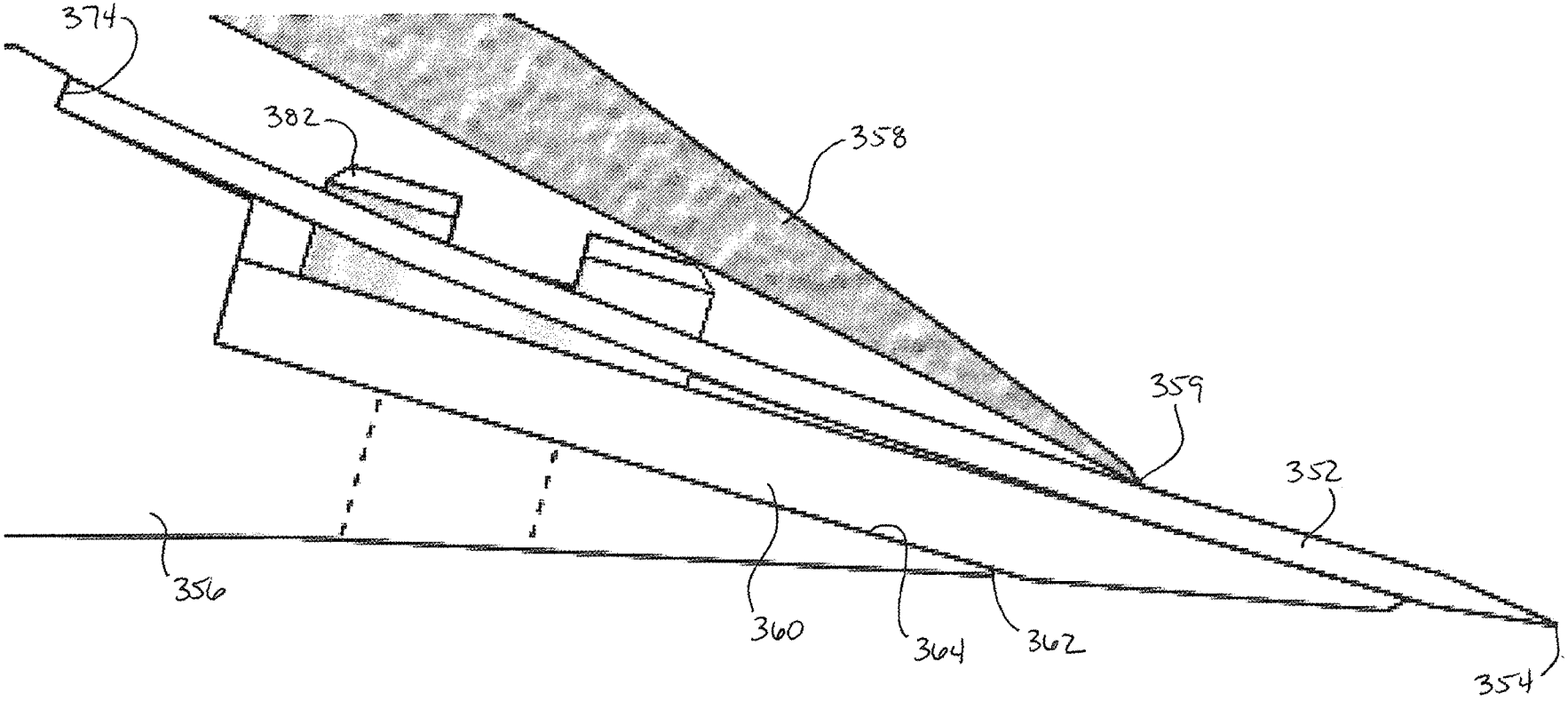

FIGS. 22A through 22C depict alternative embodiments in which the insert 360 is directly secured to the recessed support surface 364 of the knife holder 356 with screws 382. As evident from FIG. 22A, the knife 352 is formed to have slots 380 in which the heads of the screws 382 are received to locate the knife 352 relative to the knife holder 356 and, in some cases, may interlock with the knife 352. FIGS. 22B and 22C show the heads of the screws 382 as directly abutting their respective inserts 360 to directly clamp the insert 360 to the recessed support surface 364 of the knife holder 356. The configurations of FIGS. 22B and 22C differ in part as a result of where the clamp 358 contacts the knife 352. Each of FIGS. 22B and 22C show contact between the clamp 358 and knife 352 as limited to an edge 359 of the clamp 358. In FIG. 22B, the edge 359 of the clamp 358 is aligned with the leading edge 362 of the knife holder 356 such that the clamp edge 359 and the leading edge 362 of the knife holder 356 are approximately equidistant to the cutting edge 354 of the knife 352. In FIG. 22C, the edge 359 of the clamp 358 is closer to the cutting edge 354 of the knife 352 than is the leading edge 362 of the knife holder 356, and the insert 360 is relatively thicker to promote its ability to support the clamping load on the knife 352. As seen in FIGS. 22B and 22C, the recessed support surface 364 of the knife holder 356 defines a trailing end against which the edge of the knife 352 opposite its cutting edge 354 abuts to positively and accurately position the knife cutting edge 354 relative to the knife holder 356.

Figure 23A:
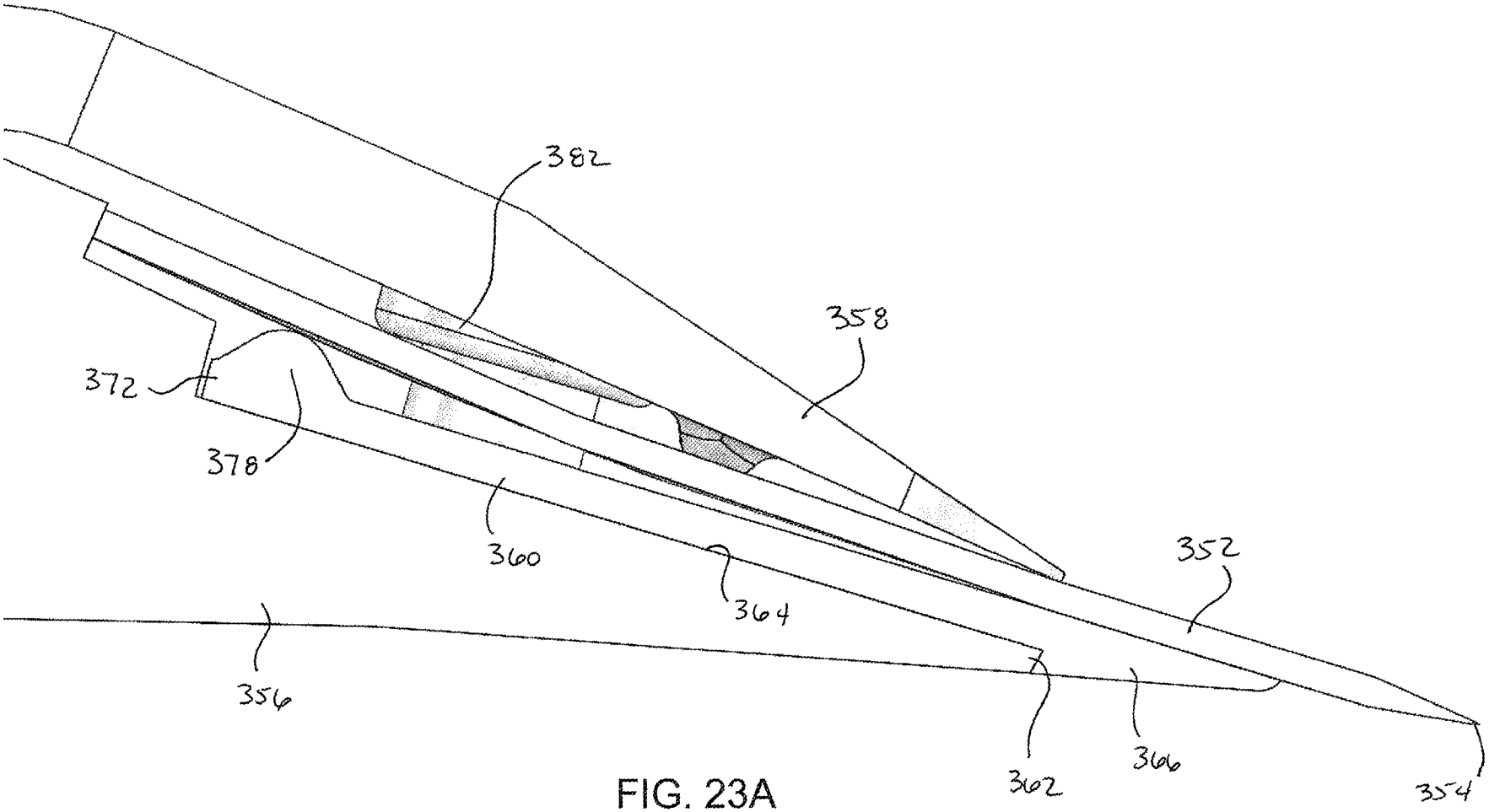
Figure 23B:
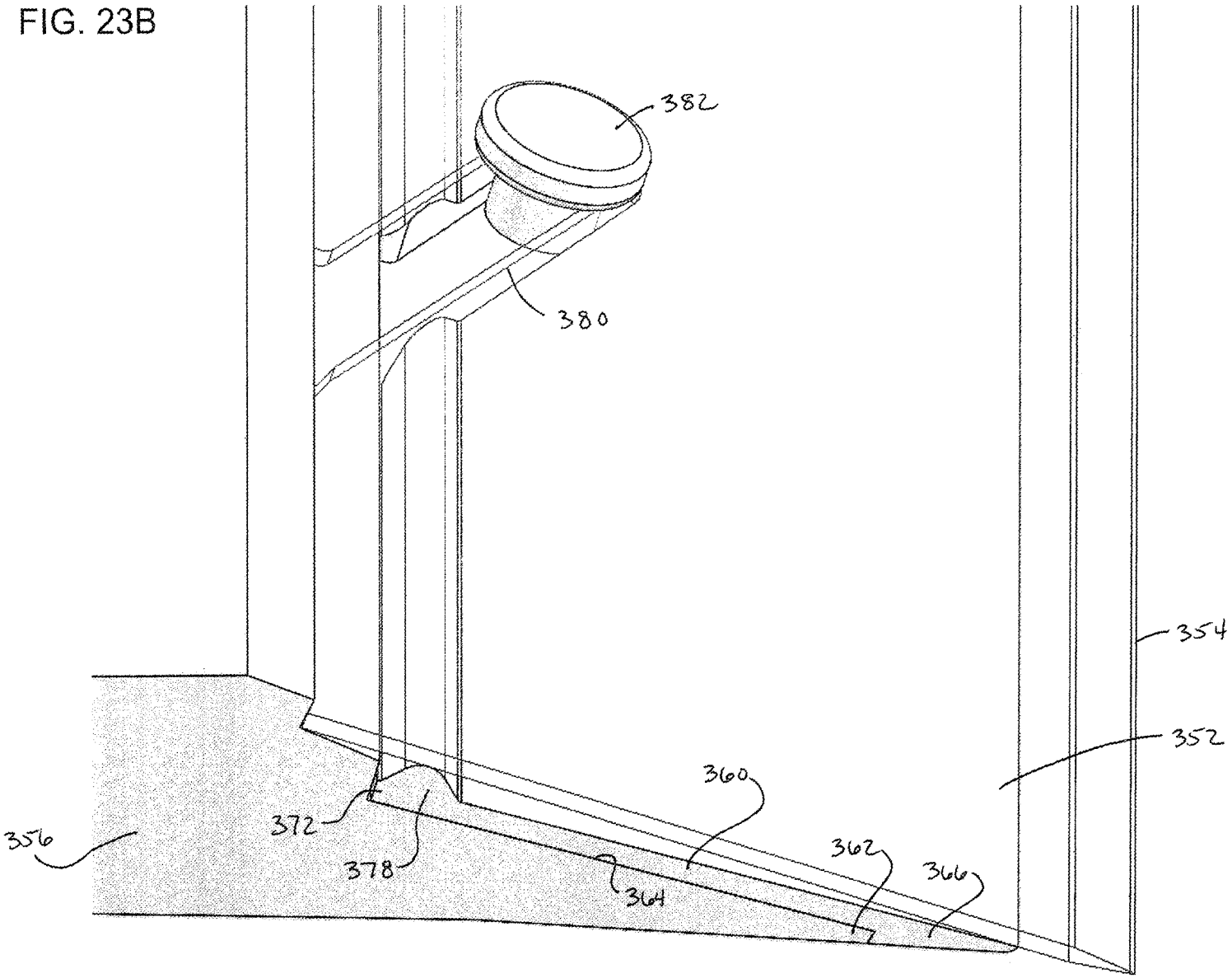

FIGS. 23A and 23B depict an alternative embodiment in which the insert 360 is directly secured to the recessed support surface 364 of the knife holder 356 with pins 382. As evident from FIG. 22A, the knife 352 is formed to have slots 380 in which the heads of the screws 382 are received and, in some cases, may interlock. The configurations of FIGS. 23A and 23B differ in part from that of FIGS. 22A through 22C because the insert 360, though positively positioned on the knife holder 356 by the pins 382, is not directly clamped to the recessed support surface 364 of the knife holder 356 with the heads of the pins 382. Instead, clamping is accomplished through the combination of the pins 382 engaging the knife 352 and the insert 360 having a protrusion 378 that contacts the surface of the knife 352 opposite the clamp 358. The insert 360 also differs from the embodiment of FIGS. 22A through 22C by the inclusion of a shoulder at its leading end 366 that directly abuts and protects the leading edge 362 of the knife holder 356.

The inserts 60, 160, 260, and 360 are preferably fabricated from materials that are capable of resisting cracking and chipping, and are also preferably corrosion resistant if the machine is used for food processing. Materials for the inserts 60, 160, 260, and 360 may also be selected relative to the material of the knife holder 56, 156, 256, and 356 to have different responses when struck by debris. As nonlimiting examples, if the knife holder is formed of a relative hard but machinable material such as 416 SS, the material for the insert may be a relatively tougher material (e.g., 17-4 SS) that may become bent from debris impacts, causing the more ductile holder to also bend, but once the insert is removed the holder can restraighten without permanent damage. Alternatively, the insert may be a more ductile material (e.g., 410 SS) relative to the knife holder, in which case the insert tends to be sacrificially damaged/bent from absorbing impact energy so that damage to the holder can be avoided or minimized.

While the invention has been described in terms of specific or particular embodiments, it should be apparent that alternatives could be adopted by one skilled in the art. For example, the machine 10, cutting head 12, impeller 14, knife assemblies, and their respective components could differ in appearance and construction from the embodiments described herein and shown in the drawings, functions of certain components of the machine 10, cutting head 12, impeller 14, and/or knife assemblies could be performed by components of different construction but capable of a similar (though not necessarily equivalent) function, and various materials could be used in the fabrication of the machine 10, cutting head 12, impeller 14, knife assemblies, and their respective components. In addition, the invention encompasses additional or alternative embodiments in which one or more features or aspects of a particular embodiment could be eliminated or two or more features or aspects of different disclosed embodiments could be combined. Accordingly, it should be understood that the invention is not necessarily limited to any embodiment described herein or illustrated in the drawings. It should also be understood that the phraseology and terminology employed above are for the purpose of describing the illustrated embodiment, and do not necessarily serve as limitations to the scope of the invention. Finally, while the appended claims recite certain aspects believed to be associated with the invention, they do not necessarily serve as limitations to the scope of the invention.

The invention claimed is:

1. A knife assembly adapted for use in a slicing machine comprising a cutting head, the knife assembly comprising:

a knife holder having a support surface that defines an outer upper surface of the knife holder and a leading edge of the knife holder, the support surface having a trailing end spaced from the leading edge;

an insert supported by the knife holder, the insert having a leading end that extends along a longitudinal extent of the knife holder and projects beyond the leading edge of the knife holder, a trailing end that extends along the longitudinal extent of the knife holder and is located on an opposite side of the insert from the leading end, and a longitudinal end between the leading and trailing ends;

a knife at least partly supported by the insert, the knife having a cutting edge that projects beyond the leading end of the insert;

means for clamping the knife to the knife holder so that a portion of the knife is between the clamping means and the insert; and means for securing the insert to the knife holder, the securing means comprising:

at least a first slot defined in at least one of the trailing end and the longitudinal end of the insert; and at least a first locking post that engages the first slot of the insert and secures the insert to the knife holder.

2. The knife assembly according to claim 1, wherein the support surface of the knife holder is recessed in the knife holder.

3. The knife assembly according to claim 2, wherein the insert is disposed on the support surface.

4. The knife assembly according to claim 3, wherein the first slot is located in the trailing end of the insert.

5. The knife assembly according to claim 4, wherein the first slot is oriented so as to be diagonal to the trailing end of the insert.

6. The knife assembly according to claim 4, further comprising a locating pin that protrudes from the support surface of the knife holder and engages a hole in the knife.

7. The knife assembly according to claim 6, wherein the trailing end of the insert has a recess defined therein that has a diametrical clearance with the locating pin.

8. The knife assembly according to claim 3, wherein the first locking post has an inverted frustoconical shape that creates an interference gripping engagement with the first slot of the insert.

9. The knife assembly according to claim 3, wherein the first slot has a shape and orientation such that the trailing end of the insert cannot be dislodged from the first locking post other than by moving the insert in a diagonal direction to the longitudinal extent of the knife holder.

10. The knife assembly according to claim 1, wherein the knife holder comprises a slot within the knife holder that defines an opening at or adjacent the leading edge of the knife holder, and the trailing end of the insert and the first locking post are disposed within the slot of the knife holder.

11. The knife assembly according to claim 10, wherein the first slot is located in the longitudinal end of the insert.

12. The knife assembly according to claim 11, wherein the first slot extends in a longitudinal direction of the insert from the longitudinal end of the insert.

13. The knife assembly according to claim 10, further comprising a locating pin that protrudes from the support surface of the knife holder and engages a hole in the knife.

14. The knife assembly according to claim 10, wherein the first slot is located in the trailing end of the insert.

15. The knife assembly according to claim 14, wherein the first slot is oriented so as to be diagonal to the trailing end of the insert.

16. The knife assembly according to claim 14, wherein the first locking post protrudes from the support surface of the knife holder to engage a hole in the knife.

17. The knife assembly according to claim 14, wherein the first slot has a shape and orientation such that the trailing end of the insert cannot be dislodged from the first locking post other than by moving the insert in a diagonal direction to the longitudinal extent of the knife holder.

18. The knife assembly according to claim 10, wherein the first slot is a channel or groove that is located in a surface of the insert and extends longitudinally along the trailing end of the insert, and the first locking post protrudes into the slot within the knife holder and engages the first slot in the insert to secure the insert to the knife holder.

19. The knife assembly according to claim 17, wherein the first locking post is disposed in a hole in the support surface of the knife holder.

20. The knife assembly according to claim 1, wherein the knife assembly is mounted in the cutting head and oriented parallel to an axis of the cutting head, the cutting head is an annular-shaped cutting head, the slicing machine further comprises an impeller coaxially mounted within the cutting head for rotation about the axis of the cutting head in a rotational direction relative to the cutting head, the impeller has means for delivering food products radially outward toward the cutting head, and the knife extends radially inward toward the impeller in a direction opposite the rotational direction of the impeller.

* * * * *